US007464520B2

(12) United States Patent
Nishi et al.

(10) Patent No.: US 7,464,520 B2
(45) Date of Patent: Dec. 16, 2008

(54) PACKING METHOD, PACKING MEMBER AND MANUFACTURING METHOD THEREFOR

(75) Inventors: Yasuhiro Nishi, Mitsukaidou (JP); Atsushi Goto, Moriya (JP); Taiji Watanabe, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/410,891

(22) Filed: Apr. 26, 2006

(65) Prior Publication Data

US 2006/0191815 A1 Aug. 31, 2006

Related U.S. Application Data

(62) Division of application No. 10/745,973, filed on Dec. 29, 2003, now Pat. No. 7,128,211.

(30) Foreign Application Priority Data

May 19, 2003 (JP) ..... 2003-140351

(51) Int. Cl.
*B65B 11/48* (2006.01)

(52) U.S. Cl. ..... 53/472; 53/403; 53/452; 53/455; 53/456

(58) Field of Classification Search ..... 53/472, 53/434, 512, 403, 449, 482, 526, 527, 455, 53/456, 452
See application file for complete search history.

(56) References Cited

U.S. PATENT DOCUMENTS

| | | | | |
|---|---|---|---|---|
| 4,528,694 A | 7/1985 | Skovgaard | 383/10 |
| 4,877,334 A | 10/1989 | Cope | 383/3 |
| 5,263,587 A | 11/1993 | Elkin et al. | 206/522 |
| 5,427,830 A | 6/1995 | Pharo | 428/35.2 |
| 5,454,642 A | 10/1995 | De Luca | 383/3 |
| 5,469,966 A | 11/1995 | Boyer | 206/522 |
| 5,826,723 A * | 10/1998 | Jaszai | 206/522 |

(Continued)

FOREIGN PATENT DOCUMENTS

EP 0 719 714 A1 7/1996

(Continued)

OTHER PUBLICATIONS

European Search Report dated Sep. 15, 2004 in European Application No. 03029889.7-2308 Nov. 28, 2005 Korean Office Action.

*Primary Examiner*—Christopher Harmon
(74) *Attorney, Agent, or Firm*—Fitzpatrick, Cella, Harper & Scinto

(57) ABSTRACT

A packing member for packing an article, includes a medium accommodating portion for accommodating medium; a non-return valve for passing the medium to the medium accommodating portion and stopping the medium away from the medium accommodating portion; an introducing portion for introducing the medium into the medium accommodating portion with the non-return valve from an outside of the packing member to balloon the medium accommodating portion; and a sealing region, disposed upstream of the non-return valve with respect to a direction of the introduction of the medium from the introducing portion toward the non-return valve, for sealing against the introduction of the medium to prevent leakage from the introducing portion to an outside of the packing member, the sealing region being sealed to keep the medium in the medium accommodating portion.

5 Claims, 30 Drawing Sheets

U.S. PATENT DOCUMENTS

| | | | | |
|---|---|---|---|---|
| 6,349,182 | B2 | 2/2002 | Otsubo et al. | 399/12 |
| 6,629,777 | B2 | 10/2003 | Tanaka et al. | 383/3 |
| 2002/0064319 | A1 | 5/2002 | Tanaka et al. | 383/3 |
| 2005/0109656 | A1 | 5/2005 | Ishizaki | 206/522 |

FOREIGN PATENT DOCUMENTS

| | | | |
|---|---|---|---|
| JP | 1-164142 | | 1/1989 |
| JP | 8-34478 | A | 2/1996 |
| JP | 9-124073 | A | 5/1997 |
| JP | 2003-63567 | | 3/2003 |

* cited by examiner (a)

(b)

PACKING METHOD, PACKING MEMBER AND MANUFACTURING METHOD THEREFOR

CROSS-REFERENCE TO RELATED APPLICATION

This is a divisional application of application Ser. No. 10/745,973, filed Dec. 29, 2003, pending.

BACKGROUND OF THE INVENTION

Field of the Invention and Related Art

The present invention relates to wrapping material for wrapping an object, a wrapping method for wrapping an object with the wrapping material in order to package the object, and a manufacturing method for the wrapping material used for packaging an object.

As for the wrapping material such as the above-described one, the wrapping material disclosed in the following publications has been known, which includes: a cushioning medium storage portion for holding cushioning medium; a check valve which allows the cushioning medium to move to the cushioning medium storage portion, but prevents the cushioning medium from flowing backward from the storage portion; and a guiding portion for guiding the cushioning medium into the cushioning medium storage portion, through the check valve, from outside the wrapping material (FIG. 2 of U.S. Pat. No. 5,427,830, and FIG. 1 of Japanese Laid-open U.M. Application 1-164142).

In the case of the wrapping materials in accordance with the above described prior art, however, there is a concern that as the wrapping material is stored for a long time in an environment which has high temperature and humidity, or an environment low in pressure, the cushioning medium in the cushioning medium storage portion of the wrapping material increases in volume, increasing thereby the internal pressure of the storage portion. The increased internal pressure in the cushioning medium storage portion forces the cushioning medium to flow backward through the check valve, gradually reducing the amount of the cushioning medium in the storage portion. As the amount of the cushioning medium in the storage portion reduces, the shock absorbing effect of the wrapping material is reduced. The present invention was made to solve this problem.

SUMMARY OF THE INVENTION

The primary object of the present invention is to provide a wrapping material reliably protecting an object in a carton, a method for packing an object, and a manufacturing method for manufacturing the packing material.

Another object of the present invention is to provide a wrapping material capable of protecting an object from external shocks, a wrapping method for wrapping an Object with the wrapping material, and a manufacturing method for the wrapping material.

Another object of the present invention is to provide a wrapping material from which the cushioning medium therein does not leak even if the cushioning medium therein flows backward due to the changes in ambience, a wrapping method for wrapping an object with the wrapping material, and a manufacturing method for the wrapping material.

Another object of the present invention is to provide a wrapping material superior in the efficiency with which cushioning medium can injected into the wrapping material, a wrapping method for wrapping an object with the wrapping material, and a manufacturing method for the wrapping material.

Another object of the present invention is to provide a wrapping material which may be injected with cushioning medium after the shipment of the wrapping material to its final destination, being therefore superior in shipment efficiency, a wrapping method for wrapping an object with the wrapping material, and a manufacturing method for the wrapping material.

Another object of the present invention is to provide a wrapping material comprising a single or plurality of cushioning medium storage portions for holding cushioning medium; a single or plurality of check valves for preventing the cushioning medium from flowing backward from the cushioning medium storage portion while allowing the cushioning medium to flow toward the cushioning medium storage portion; a single or plurality of guiding portions for guiding the cushioning medium from outside the wrapping material into the cushioning medium storage portion through the check valve, in order to inflate the cushioning medium storage portion; a sealing area, which is located on the upstream of the check valve, in terms of the direction in which the cushioning medium is guided to the check valve through the guiding portion, and across which the guiding portions are sealed after the injection of the cushioning medium into the cushioning medium storage portion, in order to prevent the cushioning medium having flowed backward from the cushioning medium storage portion into the guiding portion through the check valve, from leaking out of the wrapping material through the guiding portion.

Another object of the present invention is to provide a wrapping method, in which when wrapping an object with a wrapping material comprising a sealing area which is located on the upstream of the check valve, in terms of the direction in which the cushioning medium is guided to the check valve through the guiding portion, and across which the guiding portions are sealed after the injection of the cushioning medium into the cushioning medium storage portion, in order to prevent the cushioning medium having flowed backward from the cushioning medium storage portion into the guiding portion through the check valve, from leaking out of the wrapping material through the guiding portion, the wrapping material is sealed across said sealing area after the object is wrapped with the wrapping material and the cushioning medium is injected into the cushioning medium storage portions.

Another object of the present invention is to provide a wrapping material manufacturing method comprising a cushioning medium guiding portion forming step for forming a single or plurality of guiding portions which are located on the upstream of the check valve, in terms of the direction in which the cushioning medium is guided toward the check valve through the guiding portion, and which have a sealing area across which the guiding portion is to be sealed after the, injection of the cushioning medium into the cushioning medium storage portions, in order to prevent the cushioning medium having flowed backward from the cushioning medium storage portion into the guiding portion through the check valve, from leaking out of the wrapping material through the guiding portion.

Another object of the present invention is to provide a unit which is removably mountable in the main assembly of an electrophotographic image forming apparatus, and can be wrapped, at least when it is transported, with a wrapping material comprising: a single or plurality of cushioning medium storage portions for holding cushioning medium; a single or plurality of check valves for preventing the cushioning medium from flowing backward from the cushioning medium storage portion while allowing the cushioning medium to flow toward the cushioning medium storage portion; a single or plurality of guiding portions for guiding the cushioning medium from outside the wrapping material into the cushioning medium storage portion through the check valve, in order to inflate the cushioning medium storage portion; a sealing area, which is located on the upstream of the check valve, in terms of the direction in which the cushioning medium is guided to the check valve through the guiding portion, and across which the guiding portions are sealed after the injection of the cushioning medium into the cushioning medium storage portion, in order to prevent the cushioning medium having flowed backward from the cushioning medium storage portion into the guiding portion through the check valve, from leaking out of the wrapping material through the guiding portion.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIGS. 14*a*, 14*b* and 14*c* are drawings of the wrapping material in accordance with the present invention; FIG. 14(*b*) is plan view (reverse side) thereof, showing the tearing of the wrapping material, which was started from the notch; and FIG. 14(*c*) is a plan view (reverse side) of the wrapping material, which has been torn across the area with no tear guiding seams.

FIGS. 19(*a*) and 19(*b*) are sectional views of combination of the wrapping material in accordance with the present invention, and the object wrapped with the wrapping material; and FIG. 19(*h*) is a sectional view of the combination of the wrapping material which does not have the second guiding portion, and the cartridge wrapped with the wrapping material.

FIG. 22(*a*) is a sectional view of the combination of the wrapping material and the object wrapped with the wrapping material, and FIG. 22(*b*) is a sectional view of the combination of the wrapping material having no cushioning medium storage portions uninjectable with air, and the object wrapped by the wrapping material.

FIGS. 23(*a*), 23(*b*), 23(*c*), and 23(*d*) show various patterns of the tear guiding portions, one for one.

DETAILED DESCRIPTION OF THE PREFERRED EMBODIMENTS

Next, the preferred embodiments of the present invention will be described with reference to the appended drawings.

Embodiment 1

(Structure of Wrapping Material)

Hereinafter, the first embodiment of the present invention will be described with reference to the appended drawings.

Figure 1:
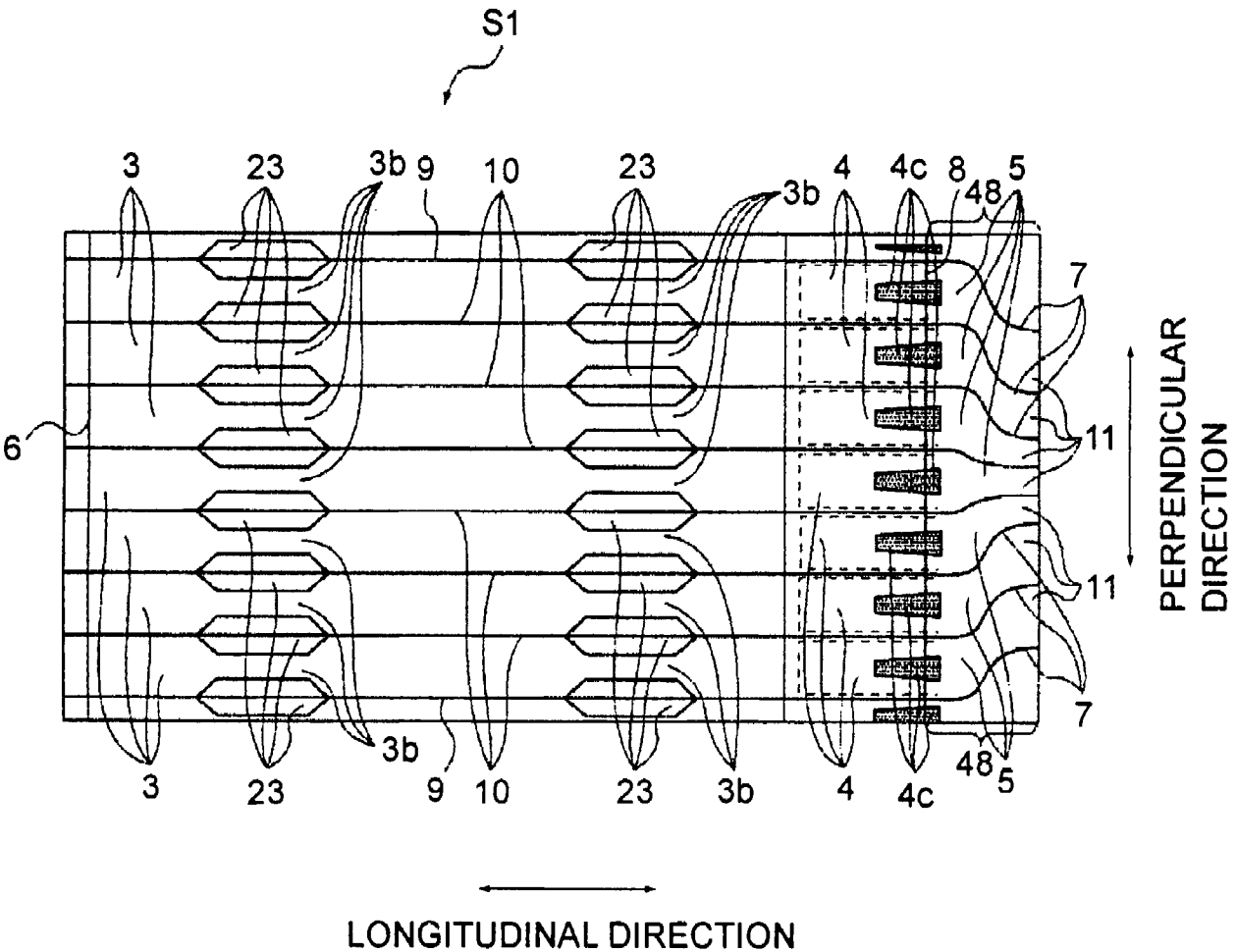
FIG. 1 is a plan view of the wrapping material in accordance with the present invention.
Figure 2:
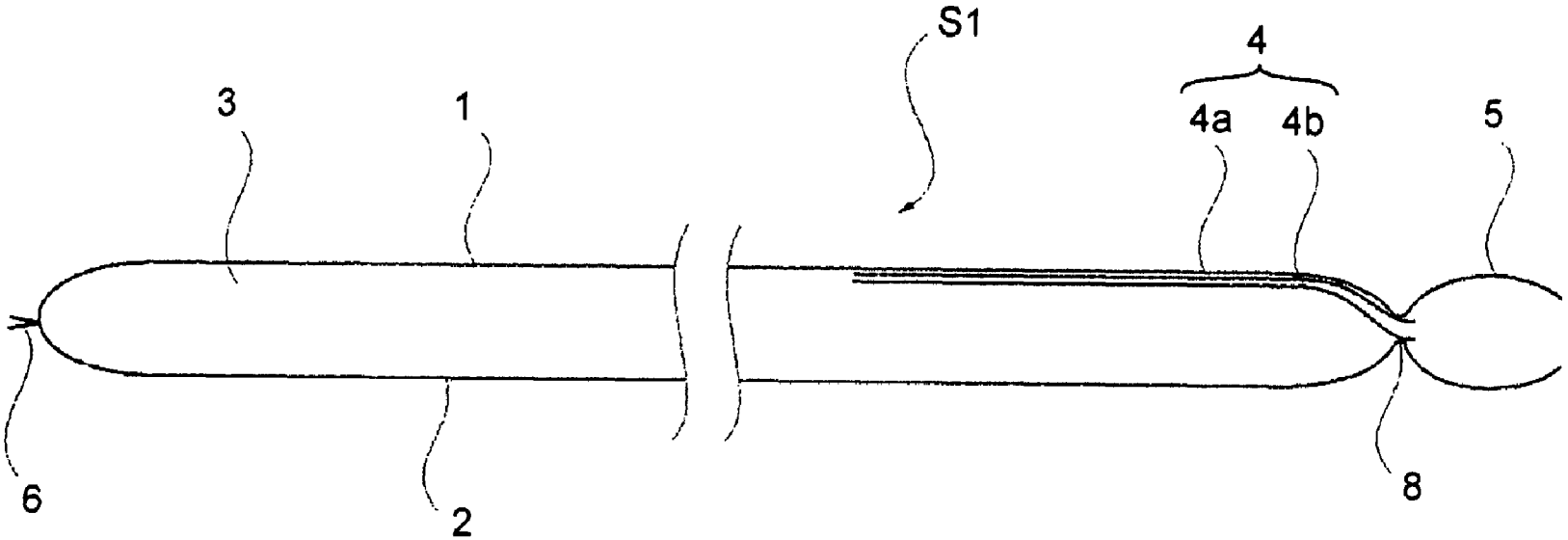
FIG. 2 is a sectional view of the wrapping material in accordance with the present invention.

Referring to FIGS. 1 and 2, a wrapping material S1, in the form of a sheet, in accordance with the present invention is a laminar sheet formed by thermally welding two pieces 1 and 2 of flexible plastic film. The lines (welding seams) designated by the numbers 6, 8, 9, and 10 are the lines along which the two pieces of flexible plastic film were thermally welded. The wrapping material S1 is provided with a plurality of parallel cushioning medium storage portions 3 in which air as cushioning medium can be stored. Each cushioning medium storage portion 3 is created by thermally welding the first and second films 1 and 2 along the welding line 10. It is shaped to be long and narrow as shown in FIG. 1. Incidentally, the flexible films 1 and 2 in this embodiment are laminar, having three layers. More specifically, they comprise a nylon layer, a polyethylene layer, and a polypropylene layer, with the nylon layer sandwiched between the polyethylene and polypropylene layers. The nylon layer is virtually imperviable by the cushioning medium, and the polyethylene and polypropylene are easier to thermally weld.

Figure 29:
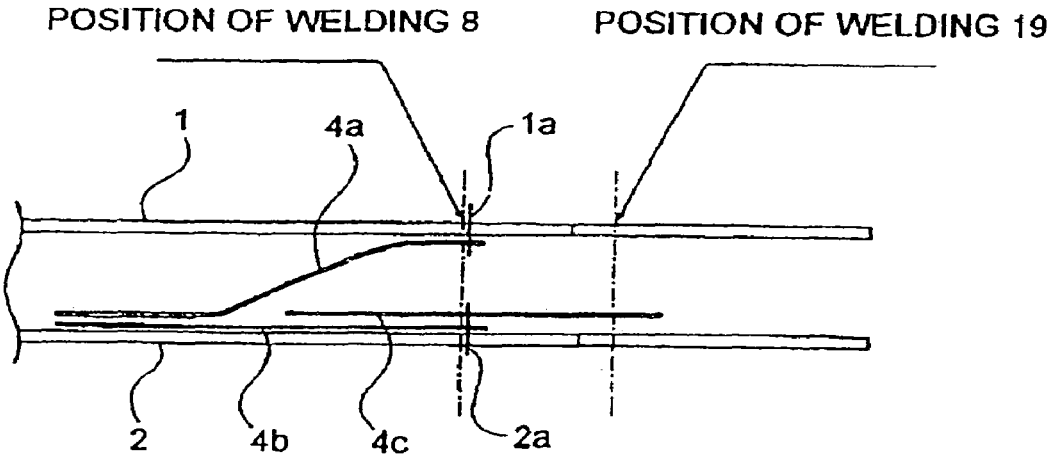
FIG. 29 is a sectional view of a check valve, and its adjacencies, of one of the cushioning medium storage portions of the wrapping material in accordance with the present invention.
Figure 30:
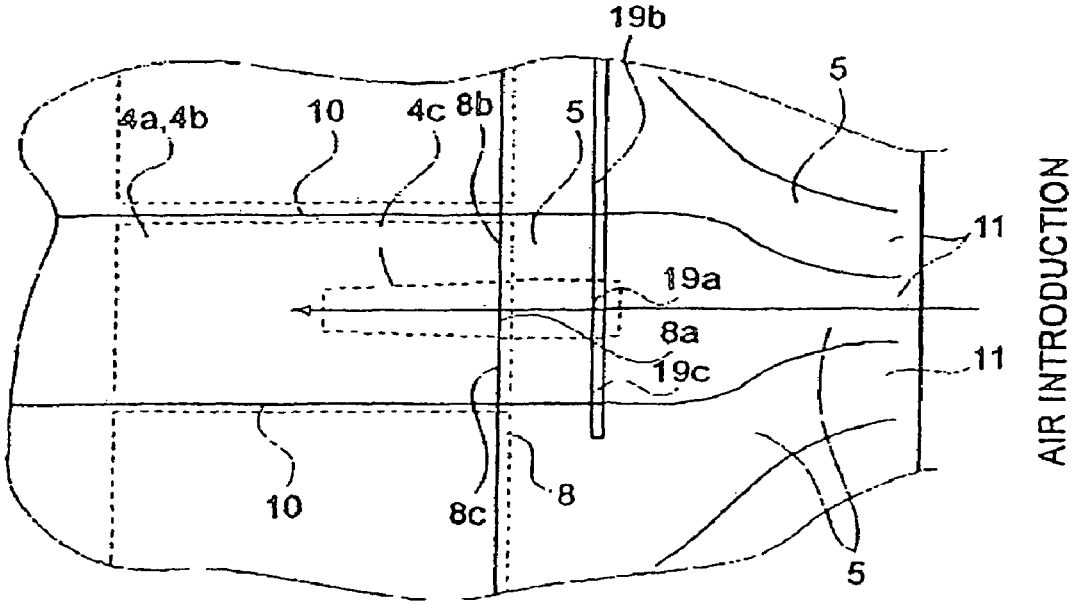
FIG. 30 is a plan view of the check valve, and its adjacencies, of one of the cushioning medium storage portions of the wrapping material in accordance with the present invention.

The cushioning medium storage portion 3 is provided with a check valve 4, which is located at one of the lengthwise ends of the cushioning medium storage 3. The check valve 4 allows air to pass through the check valve 4 in the direction to be filled into the cushioning medium storage portion 3. Referring to FIG. 2, after the filling of air into the cushioning medium storage portion 3, the pressure generated by the air in the cushioning medium storage portion 3 is used by the check valve 4 to prevent the air in the cushioning medium storage portion 3 from flowing backward. The detailed structure or the check valve 4 is shown in FIGS. 29 and 30. The check valve 4 is manufactured through the following procedure. The film 1 is provided with the top portion of the check valve 4, which is temporarily attached to the portion 1*a* of the film 1. The film 2 is provided with the bottom portion 4*b* of the check valve 4, and the sealing portion 4*c* of the check valve 4, which also are temporarily attached to the film 2. The films 1 and 2 are thermally welded to each other along the lines 6, 8, 9, and 10, as shown in FIG. 1. The sealing member 4*c* is formed of a material which does not melt at the temperature level at which the two films 1 and 2 are welded to each other along the line 8. The lines 9 and 10 extend in parallel in the lengthwise direction of the cushioning medium storage portion 3. The lines 6 and 8 extend in the direction perpendicular to the lengthwise direction of the cushioning medium storage portion 3. The line 6 is located at the opposite lengthwise end of the wrapping material 51 from the area 8.

Referring to FIG. 30, the two films 1 and 2 are welded along the portions 8*b* and 8*c*, of the line 8 (welding seam), but not across the portion 8*a* which corresponds in position to the sealing member 4*c*, allowing air to be guided into the cushioning medium storage portion 3 in the direction indicated by an arrow mark. The lengthwise direction of the cushioning medium storage portion 3 is virtually the same as the direction in which air is allowed to pass through the check valve 4, making it possible for air to be efficiently guided into the cushioning medium storage portion 3.

Figure 6:
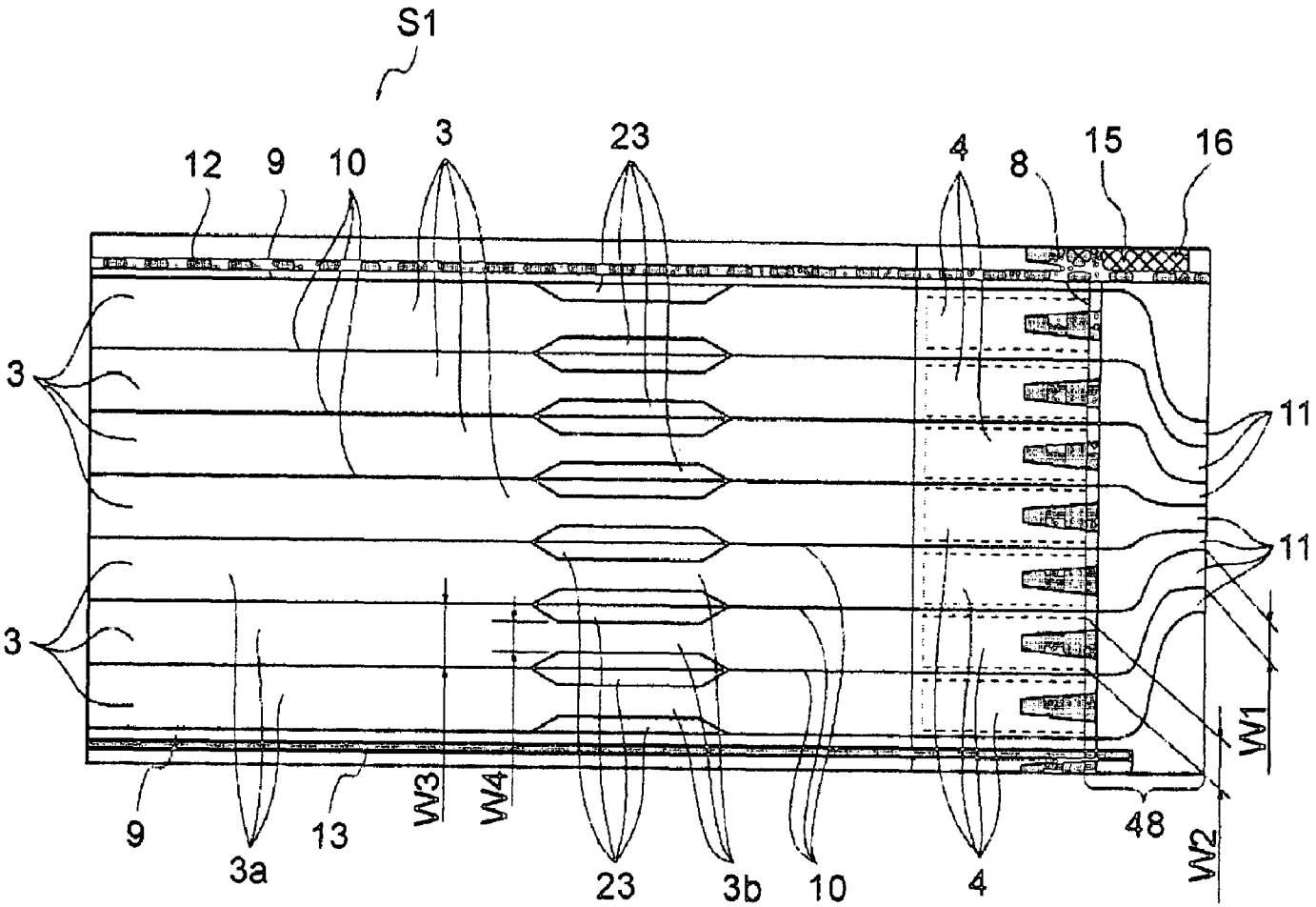
FIG. 6 is a plan view of the wrapping material in accordance with the present invention, showing another step for wrapping a cartridge with the wrapping material in accordance with the present invention.

The wrapping material S1 is also provided with a plurality of guiding portions 5 through which medium (air) is guided into the plurality of cushioning medium storage portions 3 through the plurality of check valves 4 from outside, in order to inflate the cushioning medium storage portions 3, one for one. The outward end of each guiding portion 5 constitutes an inlet 11 through which air is injected into the cushioning medium storage portion 3. The guiding portions 5 are also created by welding the films 1 and 2 to each other. The line along which the two films 1 and 2 are welded is the line 7. Referring to FIG. 6, the width WI of each inlet 11 is less than the width W2 of the joint between the guiding portion 5, and the check valve 4 located on the downstream side of the guiding portion 5, in terms of the above described medium injection direction. Further, the plurality of inlets 11 are positioned side by side, making it possible to reduce, in size, the outlet portion (unshown) of an injecting apparatus, for injecting air into all the cushioning medium storage portions 3 all at once through their inlets I1. With the provision of the above-described structural arrangement, the direction in which air is injected into the plurality of guiding portions 5 is virtually the same as the direction in which air is guided into the cushioning medium storage portions 3 through the check valves 4, one for one. Therefore, air can be efficiently injected into the plurality of cushioning medium storage portions 3. Further, each of the lines 7 (welding seams), which extends from the joint between the check valve 4 and guiding portion 5 to the inlet 11, is bent toward the inlet 11.

The area 48 of the wrapping material S1 is the area across which the films 1 and 2 are welded to each other to seal the guiding portions 5 in order to prevent the air having flowed backward from the cushioning medium storage portions 3 into the guiding portions 5 through the check valves 4, from leaking out of the wrapping material S1. The wrapping material S1 is sealed across this area 48 by a dedicated welding apparatus (unshown) after the injection of air into the cushioning medium storage portions 3.

Each of the cushioning medium storage portions 3 is provided with a pair of portions 3*b*, which are narrower, in terms of the direction perpendicular to the lengthwise direction of the cushioning medium storage portion 3, than the rest of the cushioning medium storage portion 3, and which are located at predetermined locations, one for one, in terms of the lengthwise direction of the cushioning medium storage portion 3. This narrow portion 3*b* of the cushioning medium storage portion 3 is provided to reduce the amount of the pressure to which an object wrapped with the wrapping material S1 is subjected after the injection of cushioning medium into the cushioning medium storage portion 3. More specifically, the wrapping material 51 is structured so that its narrow portions 3*b* correspond in position to the portions of an object to be wrapped, which could be damaged (deformed) by the contact pressure between the wrapping material 51 and the object. Referring to FIG. 6, the width W4 of the narrow portion 3*b* is less than the width W3 of the other portions of the cushioning medium storage portion 3. In other words, the cross section of the narrow portion 3*b* of the cushioning medium storage portion 3 is less than that of the other portions of the cushioning medium storage portion 3. Also referring to FIG. 6, the narrow portion 3*b* can be formed by widening, in the direction perpendicular to the lengthwise direction of the cushioning medium storage portion 3, the welding seam 23 by which the films 1 and 2 are welded to each other to be wider than the welding seam 10. The welding seam 23 is also formed by an dedicated welding apparatus (unshown).

The above described structure of the wrapping material 51 can be summarized as follows.

The wrapping material S1 is characterized in that it comprises: the cushioning medium storage portions 3 for storing the cushioning medium; the check valves 4 which allow the cushioning medium to pass through them into the cushioning medium storage portions 3, one for one, but prevent the cushioning medium from flowing backward from the cushioning medium storage portions 3 through them; the guiding portions 5 for guiding the cushioning medium into the cushioning medium storage portions 3, one for one, through the check valves 4 from outside the wrapping material 51, in order to inflate the cushioning medium storage portions 3; the area 48 which is positioned upstream, in terms of the direction in which the cushioning medium is guided through the guiding portions 5 to the check valves 4, one for one, of the check valves 4, in order to prevent the portion of the cushioning medium having flowed backward from the cushioning medium storage portions 3 into the guiding portions 5 through the check valves 4, from leaking out of the wrapping material 51, and across which the wrapping material S1 is sealed after the cushioning medium storage portions 3 are filled with the cushioning medium.

Each cushioning medium storage portion 3 is shaped to be long and narrow, and its lengthwise direction is virtually the same as the direction in which the cushioning medium flows through the check valve 4.

Each guiding portion 5 has the inlet 11, which is located at the outward end of the guiding portion 5, and through which the cushioning medium is injected into the cushioning medium storage portion 3 from outside the wrapping material S1. The direction in which the cushioning medium is injected into the cushioning medium storage portion 3 is roughly the same as the direction in which the cushioning medium flows into the cushioning medium storage portion 3 through the check valve 4.

The plurality of cushioning medium storage portions 3 are positioned parallel to each other. The check valves 4 provided one for each of the plurality of cushioning medium storage portions 3 are independent of each other, and so are the guiding portions 5.

The area 48 is located so that the plurality of guiding portions 3 become roughly the same in the amount by which the cushioning medium can be stored in each of the guiding portions 5 after the sealing of the wrapping material S1 across the area 48.

Each of the plurality of guiding portions 5 is provided with the inlet 11, which is positioned at the upstream end of the guiding portion 5, in terms of the cushioning medium injection direction, to inject the cushioning medium into the cushioning medium storage portion 3 from outside the wrapping material S1. The width WI of the inlet 11 is less than the width W2 of the joint between the guiding portion 5, and the check valve 4 located downstream of the guiding portion 5 in terms of the cushioning medium injection direction. Since the width WI of the inlet 11 is less than the width W2 of the joint, and the plurality of inlets 11 are positioned immediately next to each other, it is possible to reduce in size the apparatus (unshown) for injecting air into the wrapping material S1 through the plurality of inlets 11. The width WI of each inlet 11 is in the range of 10-15 mm, and the width W2 of each joint is in the range of 25-30 mm.

Further, in order to reduce the pressure which is applied to an object wrapped with the wrapping material 51, after the injection of the cushioning medium into the cushioning medium storage portions 3, each cushioning medium storage portion 3 is provided with the portions 3*b* which are narrower, in terms of the direction perpendicular to the lengthwise direction of the cushioning medium storage portion 3, than the other portions of the cushioning medium storage portion 3, and which are positioned at the predetermined locations, one for one, in terms of the lengthwise direction of the cushioning medium storage portion 3.

Generally, a wrapping material such as the wrapping material S1 in this embodiment, having a plurality of cushioning medium storage portions 3 a plurality of check valves 4, and a plurality of guiding portions 5, comes in the form of a roll including a substantial number of wrapping materials S1. In order to obtain a wrapping material suitable in size for properly wrapping a given object, a single or plural wrapping materials S1 are cut from the roll of wrapping material. The obtained single or plural units of the wrapping materials S1 are processed as described above to properly wrap the object. Next, one of the methods for wrapping an object with the above described wrapping material, will be described.

(Wrapping Method Which Uses Wrapping Material in Accordance with Present Invention)

Referring to FIGS. 3-9, the method for packaging a process cartridge removably mountable in the main assembly of an electrophotographic image forming apparatus, with the use of the wrapping material 5 will be described. Incidentally, an electrophotographic image forming apparatus refers to an apparatus for forming an image on a recording medium with the use of an electrophotographic image forming method. As examples of an electrophotographic image forming apparatus, there are an electrophotographic copying machine, an electrophotographic printer (for example, laser beam printer, LED printer, etc.) a facsimile machine, a word processor, etc.

A process cartridge refers to a cartridge in which a minimum of one processing means among a charging means, a developing means, and a cleaning means, are integrally disposed, along with an electrophotographic photosensitive member, and which is removably mountable in the main assembly of an image forming apparatus.

Figure 3:
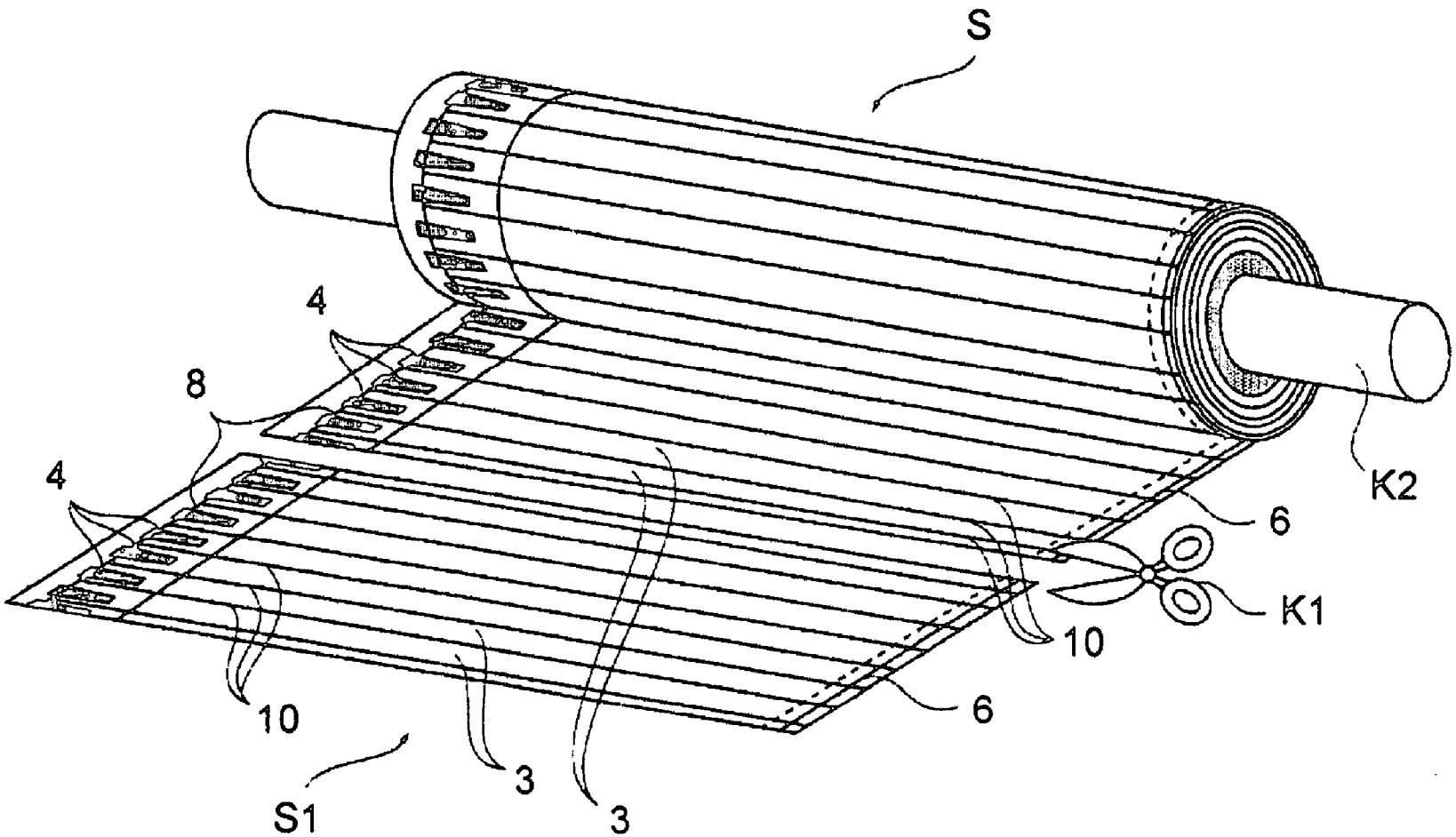
FIG. 3 is a perspective view of the partially unrolled roll of the wrapping material in the preferred embodiment of the present invention, showing one of the steps for wrapping a cartridge with the wrapping material in accordance with the present invention.

(1) Cutting of Wrapping Material from Wrapping Material Roll (FIG. 3)

The roll S of sheet made up of a substantial number of wrapping materials comprising: a plurality of the cushioning medium storage portions 3, plurality of check valves 4, and plurality of guiding portions 5, and connected by lengthwise edges, is to be cut in the long direction to a piece having the length necessary to properly wrap a process cartridge 35. In this embodiment, the roll is cut with a pair of scissors K1. However, it may be cut with a cutter, or a dedicated cutting apparatus. The wrapping material roll S has a metallic core K2, which is in the center of the roll S, making it easier to pullout the wrapping material Sheet S to cut it. Further, the provision of the metallic core K2 makes it easier to set the roll S of sheet of wrapping materials in a predetermined position, in an automatic cutting apparatus or the like.

Figure 4:
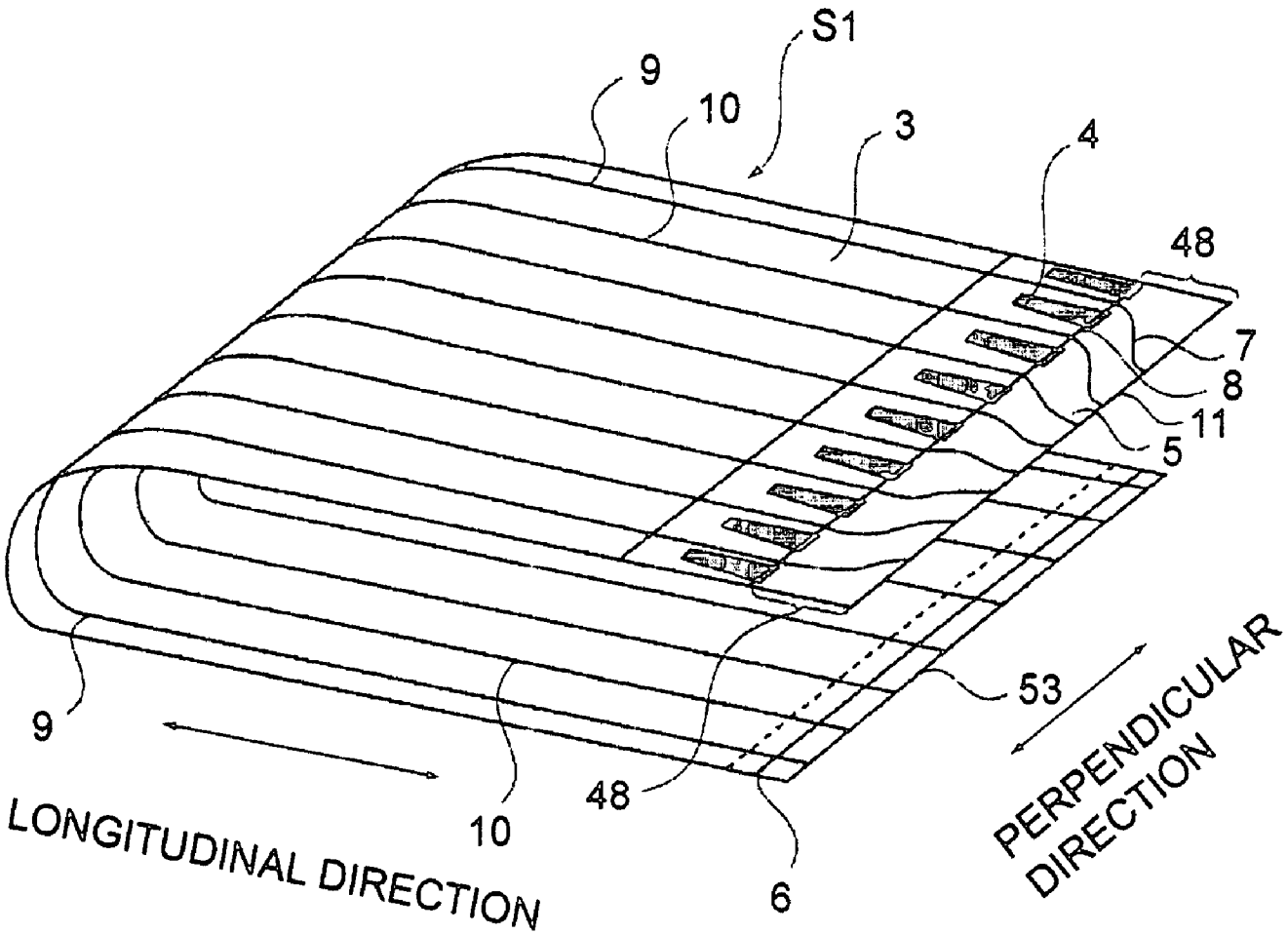
FIG. 4 is a perspective view of the wrapping material in accordance with the present invention, showing another step for wrapping a cartridge with the wrapping material in accordance with the present invention.
Figure 5:
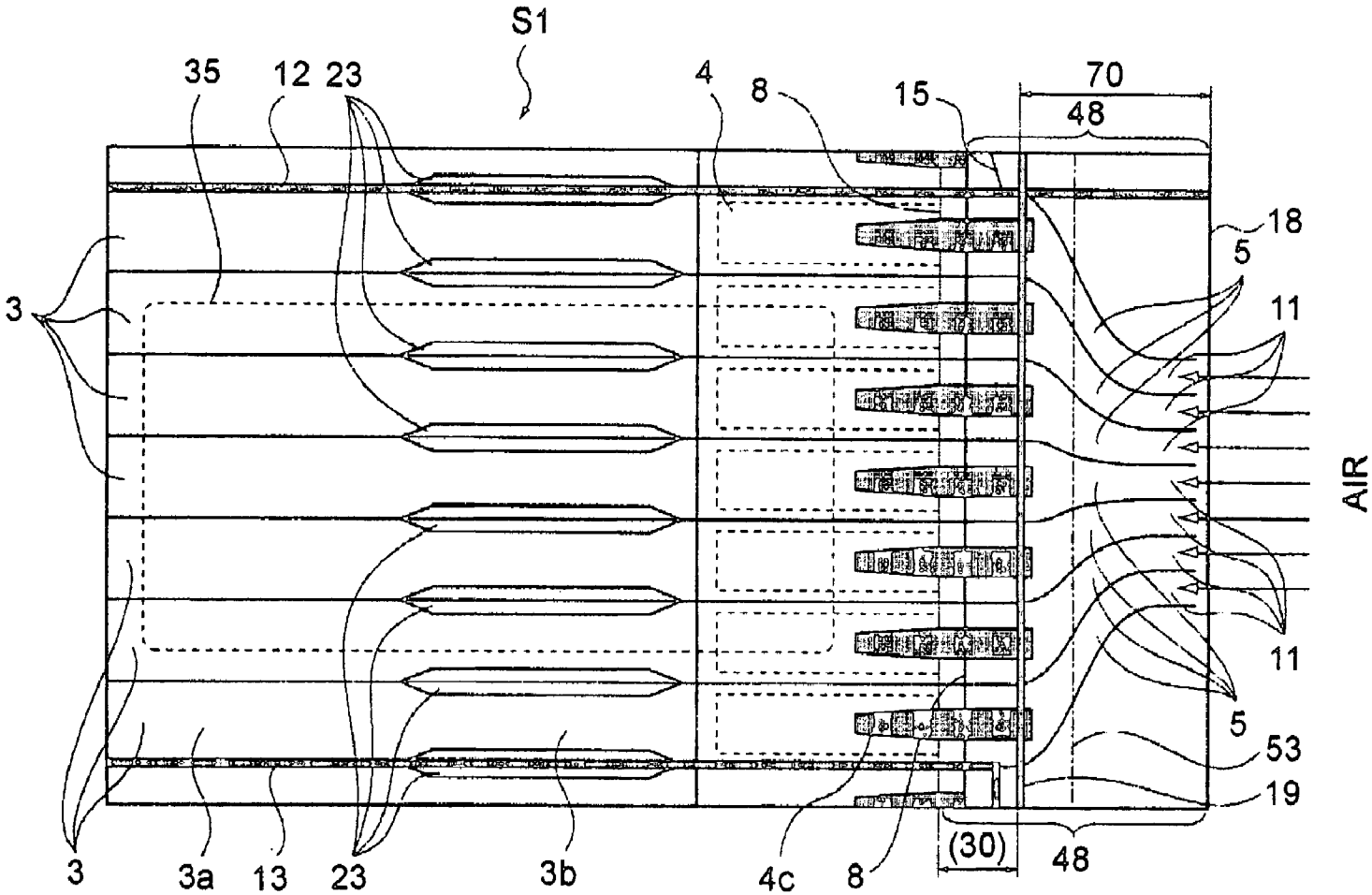
FIG. 5 is a plan view of the wrapping material in accordance with the present invention, showing another step for wrapping a cartridge with the wrapping material in accordance with the present invention.

(2) Process for Turning Wrapping Material into a Pouch (FIGS. 4-6)

The wrapping material SI separated from the roll S is to be folded in half roughly at the center thereof in terms of the lengthwise direction of the cushioning medium storage portion 3, so that the downstream end 53 of the wrapping material S1 meets the area of the wrapping material S1 shown in FIG. 5.

Then, one half of the wrapping material S1 is to be welded to the other half along the edge areas (lines 12 and 13) to form the wrapping material S1 into a pouch having an opening at one of the lengthwise ends. Incidentally, the lines 12 and 13 (welding seams) extend in the lengthwise direction of the cushioning medium storage portion 3.

Although the following will be described later in detail, the wrapping material S1 is provided with a small notch 15, which is provided to make it easier to tear the wrapping material S1 when removing an object from the pouch made of the wrapping material S1. The notch 15 is also the portion of the wrapping material S1, from which the wrapping material can be easily torn to create openings for cushioning medium storage portions, one for one, in order to release the cushioning medium in the cushioning medium storage portions.

In this embodiment, the wrapping material S1 was formed into a pouch, which was open at one of the lengthwise ends. However, the wrapping material S1 may be formed into a pouch, which is open at one or both ends in terms of the direction perpendicular to the lengthwise direction of the cushioning medium storage portion 3. Moreover, it may be formed into a pouch, which is open at one of the lengthwise ends, as well as one of the ends in terms of the direction perpendicular to the lengthwise end of the cushioning medium storage portion 3.

(3) Insertion of Object (Cartridge 35) into Pouch Formed of Wrapping Material 51 (FIG. 5)

Referring to FIG. 5, the cartridge 35, an object to be packaged, is to be inserted into the pouch formed of wrapping material 51 (which hereafter may be referred to as "pouch 51") through the opening 18 located at one of the lengthwise ends thereof. In other words, the cartridge 35 is inserted so that the lengthwise direction of the cartridge 35 becomes virtually parallel to the lengthwise direction of the cushioning medium storage portion 3. Thereafter, the front and reverse sides of the pouch 51 are welded to each other across the line 19 (pouch 51 is thermally sealed), to seal the inlet 18 in order to airtightly seal the cartridge 35 in the pouch 51. The line 19 (welding seam) extends in the direction perpendicular to the lengthwise direction of the cushioning medium storage portion 3. In other words, the line 19 (welding seam) extends in the direction parallel to the shorter edges of the cartridge 35. It is located closer to the inlet 11 than the line 18 (welding seam) and check valve 4. However, across each of the sections 19*a* of the line 19, the front and reverse sides of the pouch 51 are not welded to each other, because the aforementioned sealing member 4*c* extends across the section 19*a*, as shown in FIG. 30. Therefore, air can be injected in the direction indicated by an arrow mark, through the check valves 4, into the cushioning medium storage portions 3 of the pouch 51 in which the cartridge 35 has been airtightly sealed.

Figure 9:
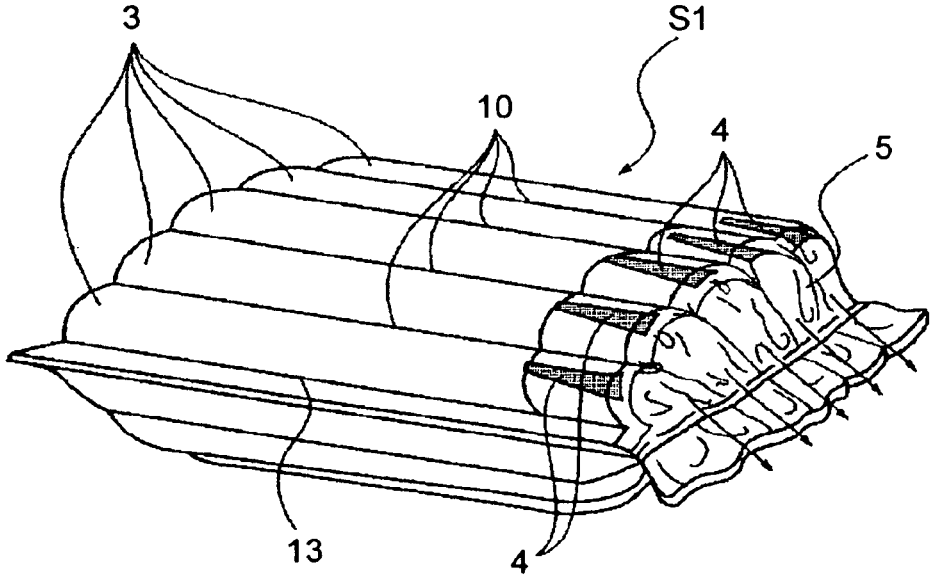
FIG. 9 is a perspective view of the wrapping material in accordance with the present invention, showing another step for wrapping a cartridge with the wrapping material in accordance with the present invention (after sealing of wrapping material).

(4) Injection of Cushioning Medium (FIGS. 5 and 9)

The cushioning medium, which in this embodiment is air, is injected into each of the cushioning medium storage portions 3 of the pouch 51 through the inlet 11, guiding portion 5, and check valve 4 of the cushioning medium storage portion 3. The reason for injecting air after the sealing of the cartridge 35 in the pouch 51 is to prevent static electricity from being induced between the cartridge 35 and the film 1 or 2 when the cartridge 35 is inserted. More specifically, it is to prevent the object (cartridge 35) being adversely affected by the static electricity which will be induced if an object (cartridge 35) is inserted into the pouch S1 after the injection of air into the cushioning medium storage portions 3 of the pouch S1. In addition, the wrapping method of injecting air after the insertion of the cartridge 35 is superior in operational efficiency than the wrapping method of injecting air before the insertion of the cartridge 35. More specifically, referring to FIG. 9, as air is injected into the pouch 51 after the insertion of the cartridge 35 into the pouch 51, pressure is gradually built up in the cushioning medium storage portions 3, and this pressure works in the direction to tension the guiding portions 5 in the direction to flatten the guiding portions 5. As a result, the air in the guiding portions 5 is forced out of the guiding portions 5 through the inlets 11 in the direction indicated by arrow marks. Incidentally, the cushioning medium injected into the cushioning medium storage portions of the pouch 51 in this embodiment is air. However, the selection of the cushioning medium does not need to be limited to air. For example, nitrogen gas, oxygen gas, or the like, may be used. In particular, nitrogen gas is less likely to leak from the cushioning medium storage portion formed of plastic film or the like, because the molecular weight of nitrogen is relatively large. Further, there will be no problem even if a fluid substance such as liquid is used as the cushioning medium.

(5) Sealing of Cushioning Medium Guiding Portion (Thermal Sealing)

Figure 10:
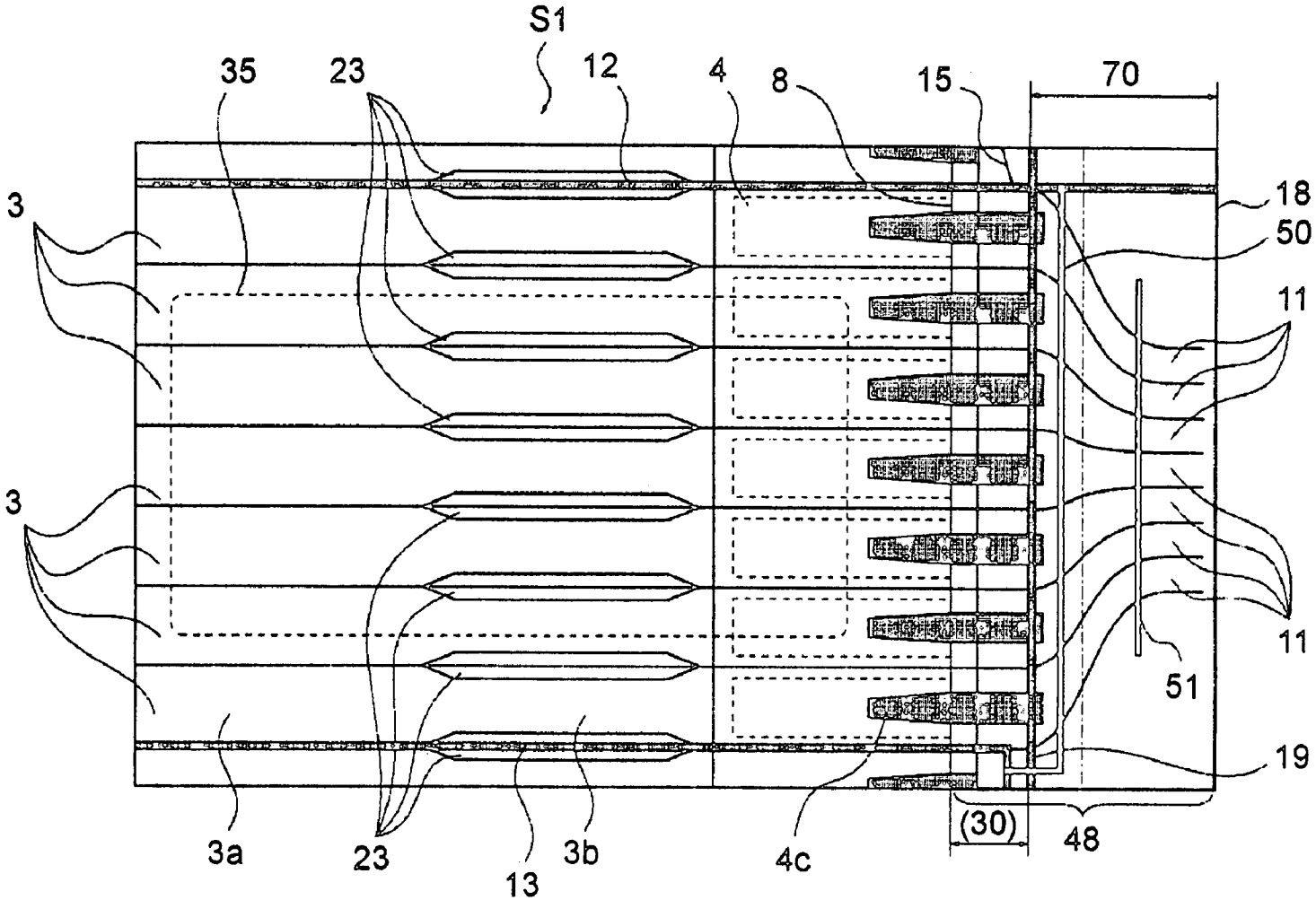
FIG. 10 is a perspective view of the wrapping material in accordance with the present invention, showing another step for wrapping a cartridge with the wrapping material in accordance with the present invention (after sealing of wrapping material).

Next, referring to FIG. 10, the pouch S1 is sealed across the portion of the area (sealing range) 48, which is on the inlet 11 side of the welding seam 8 in terms of the lengthwise direction of the cushioning medium storage portion 3. More specifically, the pouch S1 is thermally sealed across the area in which the cushion medium guiding portions 5 are present, more specifically, along the line 50, which makes the cushioning medium capacity of the portion of the cushioning medium guiding portion 5, between the welding seam 8 and line 50, after the sealing of the pouch S1 along the line 50, equal to 5%-10% of the total cushioning medium capacity of the cushioning medium storage portion 3. The line 50, along which the pouch S1 is welded (thermally sealed), extends in the direction perpendicular to the lengthwise direction of the cushioning medium storage portion 3. This process, which will be described later in detail, is done to prevent the problem that as the pouch S1 is left unprotected in an environment which is high in temperature and humidity, and/or low in pressure, for a long period of time, the injected air in the cushioning medium storage portions 3 expands and leaks out of the pouch S1 (cushioning 25 medium storage portions 3). In other words, the pouch S1 is thermally sealed across the area 48 to provide the cushioning medium storage portions 3 with regions, one for each cushioning medium storage portion 3, in which the air having flowed backward through the check valve 4 can be held, up to a certain amount. In addition, in this embodiment, the pouch S1 is thermally sealed along a line S1, which is on the inlet 11 side of the line 50. This process is done to prevent the air having escaped through the welding line 50 from leaking out of the inlet 11. The welding line 51 also extends in the direction perpendicular to the lengthwise direction of the cushioning medium storage portion 3.

Figure 8:
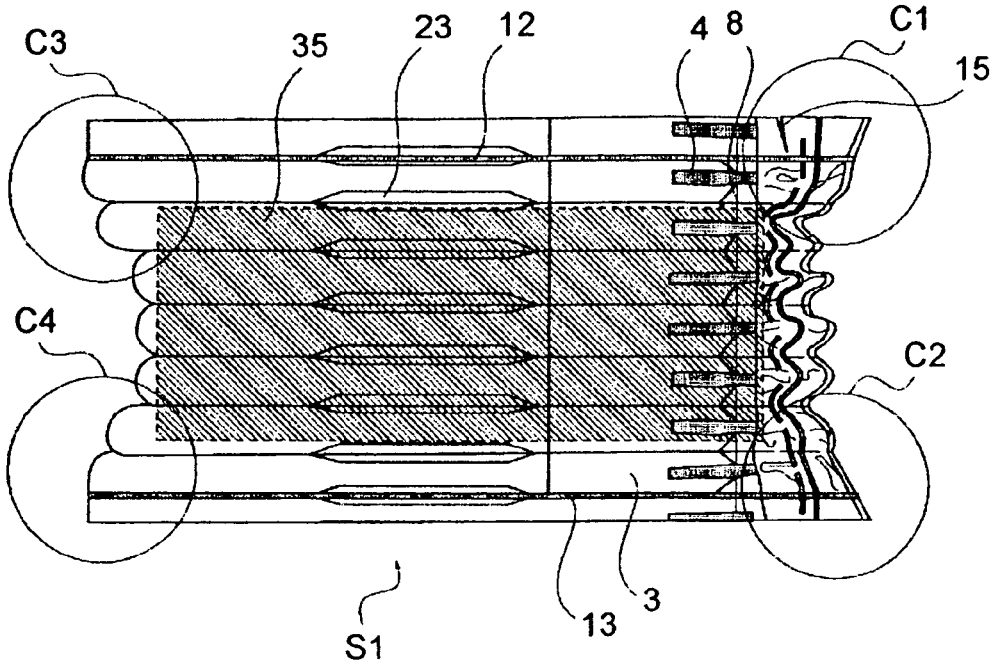
FIG. 8 is a perspective view of the wrapping material in accordance with the present invention, showing another step for wrapping a cartridge with the wrapping material in accordance with the present invention (cartridge insertion step).

Further, referring to FIG. 8, as the cushioning medium is injected into the cushioning medium storage portions 3 of the pouch S1 containing the cartridge 35, the pouch 51 changes in shape so that the four corners (C1, C2, C3, and C4) thereof stick out relative to the edge between the corners C1 and C2, and the edge between the C3 and C4. These projecting corners C1, C2, C3, and C4 add to the shock absorption performance of the pouch 51, better protecting the object therein when the pouch 51 containing the object landed on one of its corners.

In this embodiment, the cartridge 35 is inserted into the pouch formed of the above-described inflatable wrapping material S1 having a desired number of inflatable cushioning units. However, the cartridge 35 may be airtightly sealed in the inflatable cushioning pouch S1 by forming the inflatable wrapping material S1 into a pouch by welding the half of the wrapping material S1, on one side of the cartridge 35, to the other half of the wrapping material S1, on the other side, along the edges, after directly wrapping (covering) the cartridge 35 with the wrapping material S1.

(6) Insertion of Wrapped Cartridge into Carton

Figure 24:
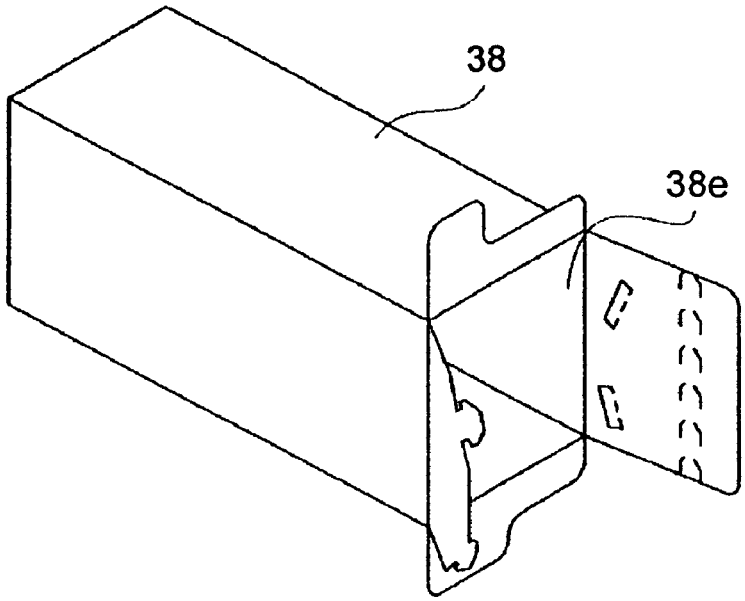
FIG. 24 is a perspective view of a preferred packaging carton in accordance with the present invention.
Figure 25:
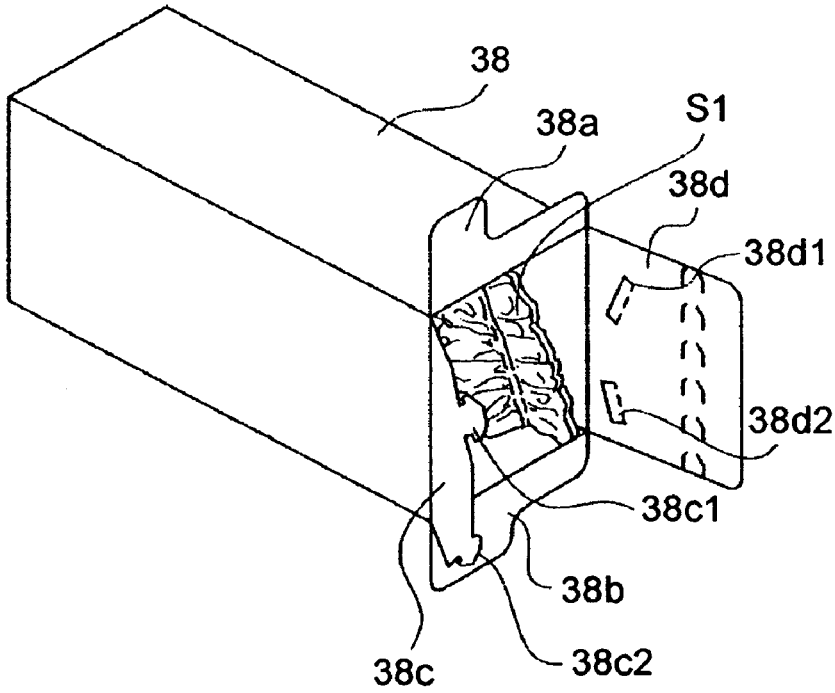
FIG. 25 is another perspective view of the preferred packaging carton in accordance with the present invention.
Figure 26:
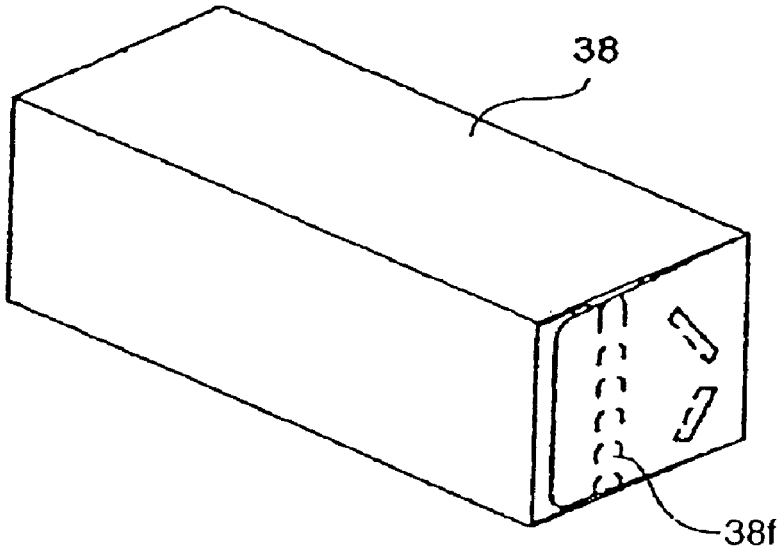
FIG. 26 is another perspective view of the preferred packaging carton in accordance with the present invention.
Figure 27:
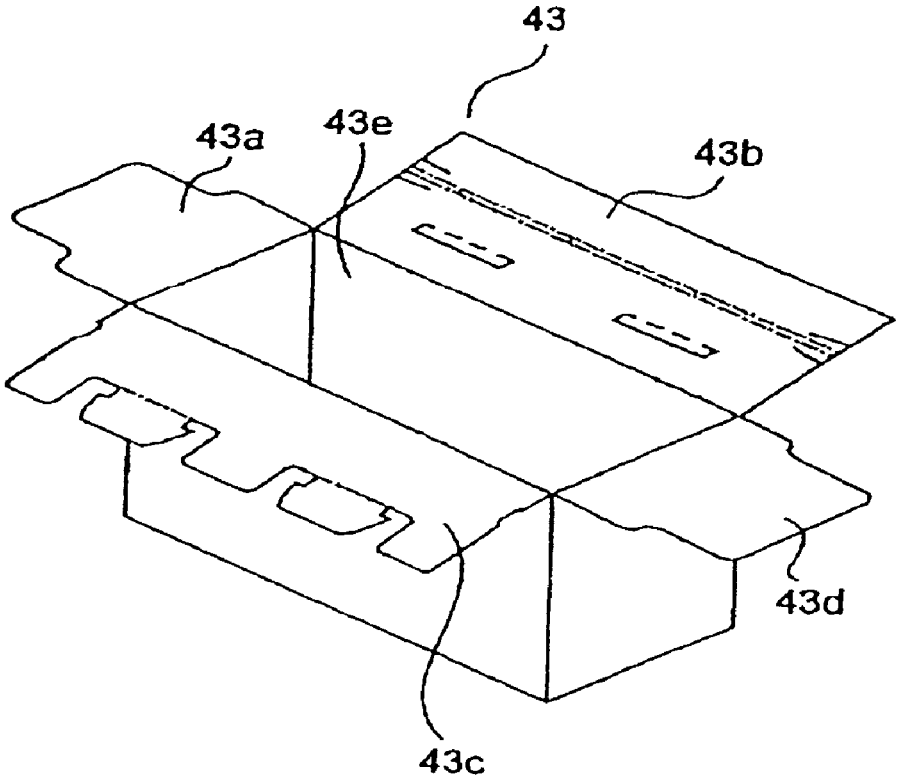
FIG.27 PRIOR ART
FIG. 27 is a perspective view of a packaging carton in accordance with the prior art.
Figure 28:
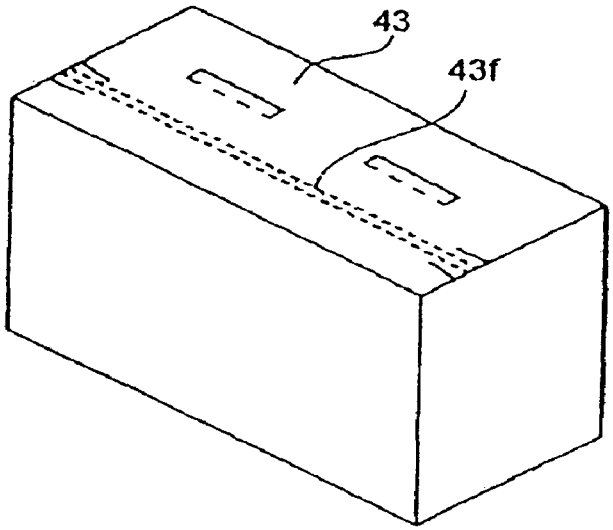
FIG.28 PRIOR ART
FIG. 28 is another perspective view of the packaging carton in accordance with the prior art.
Figure 34:
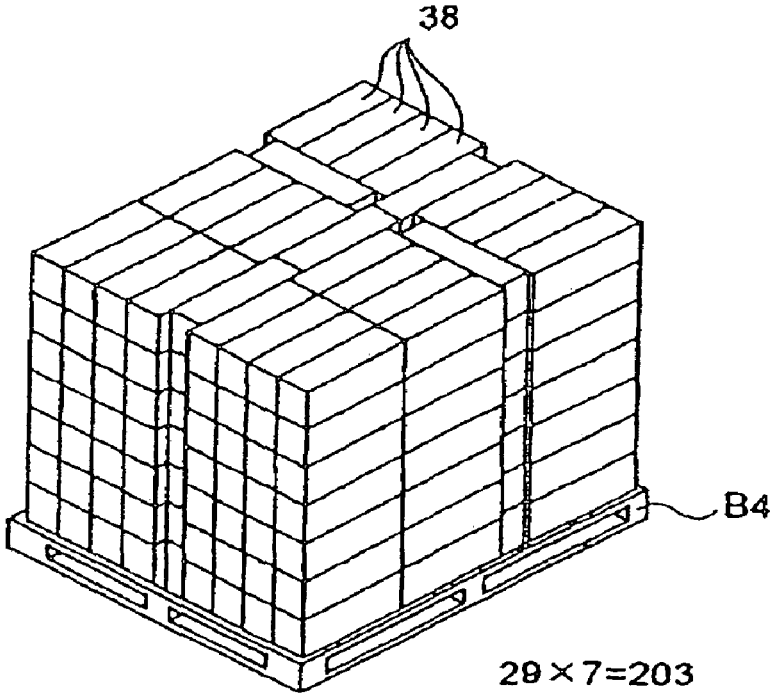
FIG. 34 is a perspective view of a transportation pallet, and 203 cartons, in accordance with the present invention, loaded on the pallet.
Figure 36:
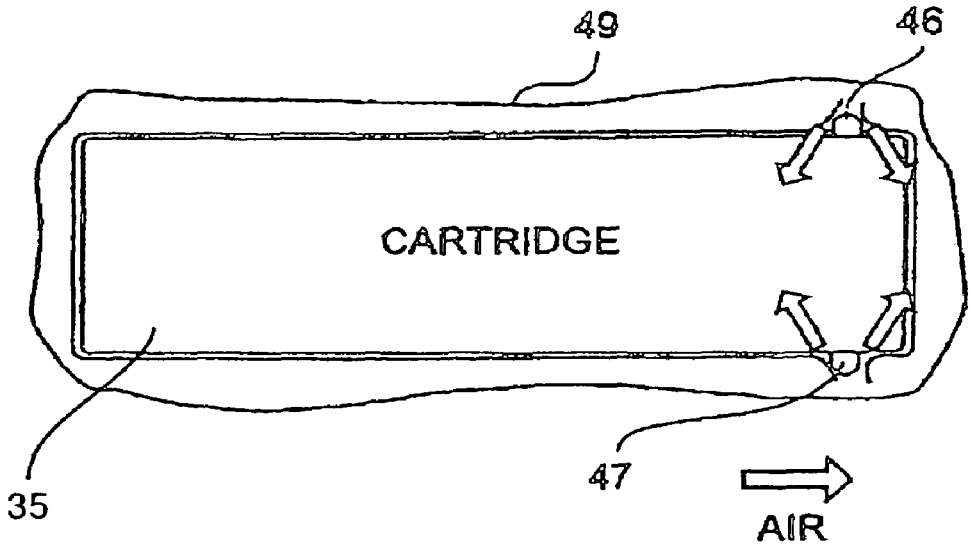
FIG. 36 is a sectional view of a combination of the wrapping material which does not have a second guiding portion, and the cartridge wrapped therewith.
Figure 37:
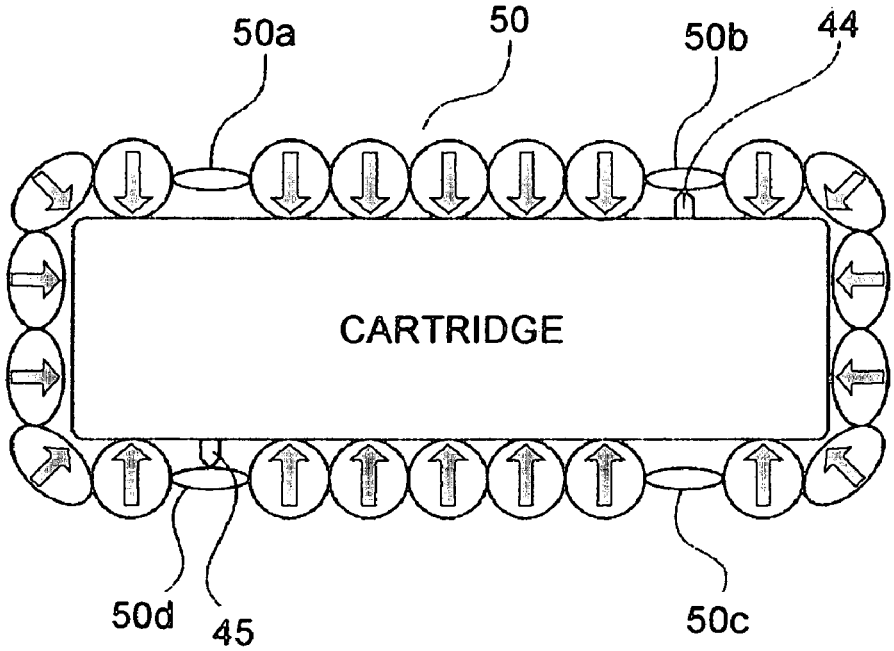
FIG. 37 is a sectional view of a combination of a wrapping material in accordance with the present invention, and the cartridge wrapped therewith.
Figure 38:
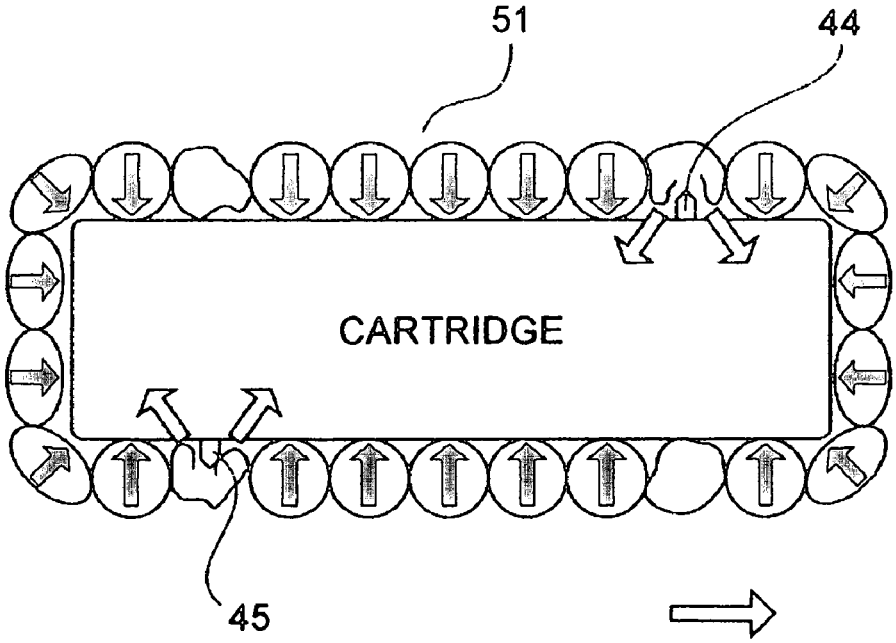
FIG. 38 is a sectional view of the combination of a wrapping material lacking the cushioning medium storage portions uninjectable with air, and the cartridge wrapped therewith.
Figure 39:
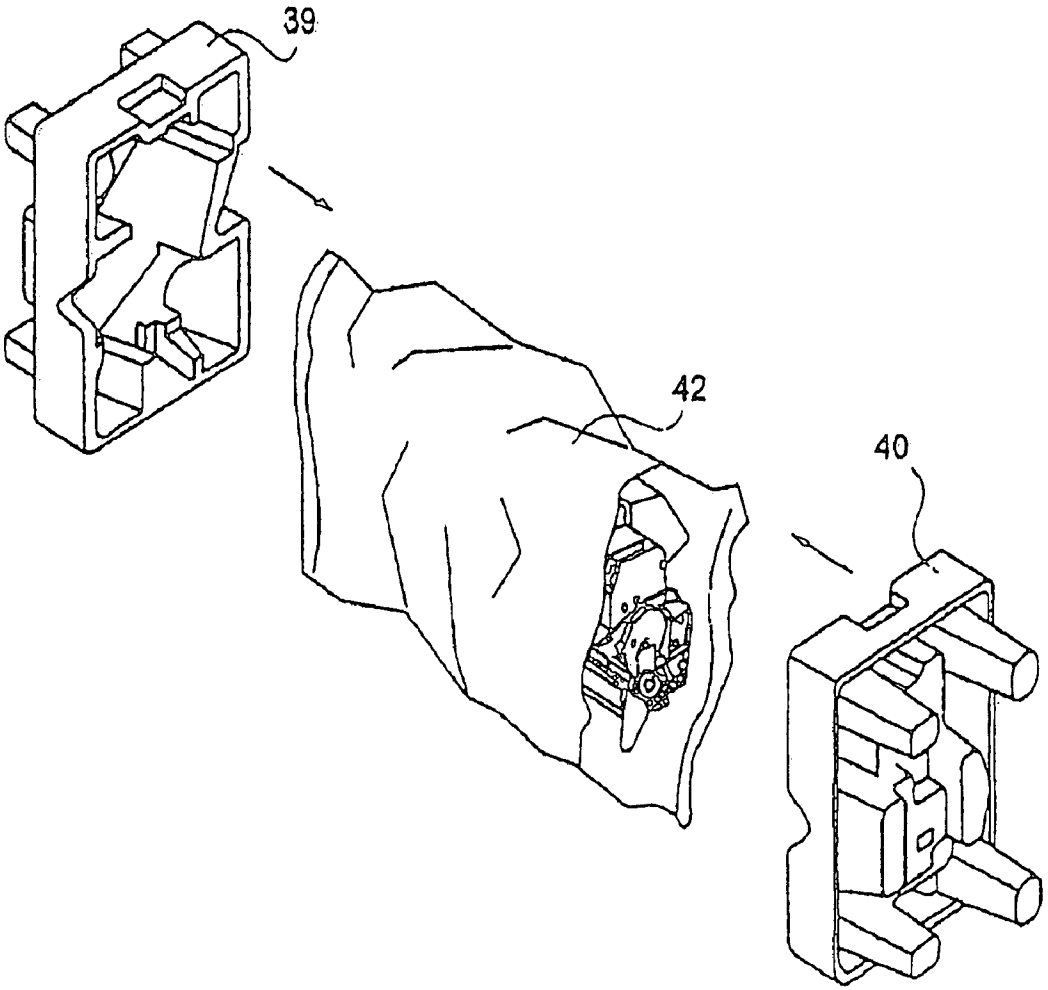
FIG. 39 PRIOR ART
FIG. 39 is a perspective view of packaging supplies in accordance with the prior art.
Figure 40:
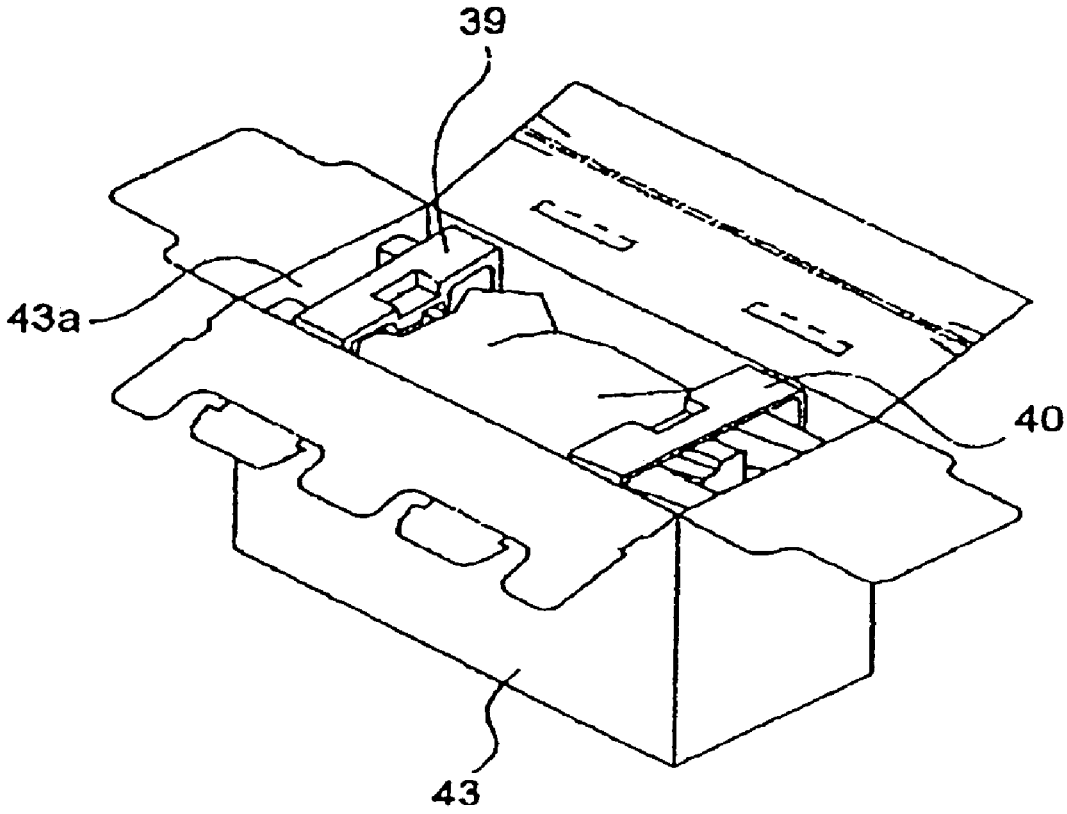
FIG.40 PRIOR ART
FIG. 40 is a perspective view of a packaging carton in accordance with the prior art, and packaging supplies therein.

The airtightly sealed pouch S1, which is formed of the inflatable wrapping material S1, and which contains the cartridge 35, is inserted into a carton 38 (FIGS. 24 and 25). Then, the tabs 38*a* and 38*b* of the carton are bent inward at 90°. Next, the tab 38*c* of the carton 38 is bent inward onto the tabs 38*a* and 38*b*. Then, the tab 38*d* of the carton 38 is bent inward onto the tab 38*c*, and is glued to the tab 38*c*. During this process, the appendages 38*c*1 and 38*c*2 of the tab 38*c* are inserted into the slits 38*d*1 and 38*d*2 of the tab 38*d*. Referring to FIGS. 24 and 34, a carton, such as the one in this embodiment, in which such an object as the cartridge 35 is placed, is structured so that the object can be inserted into the carton from one of the lengthwise ends. In comparison, a carton in accordance with the prior art is structured so that the object (cartridge 35) is to be inserted into the carton from the direction perpendicular to one of the lateral walls of the carton as shown in FIGS. 27 and 36 for the following reason. That is, according to the prior art the cartridge 35 is immovably placed in a packaging carton 43 through the following steps: the cartridge 35 is inserted into a packaging bag 42; a pair of side pads 39 and 40 are fitted to the lengthwise ends of the cartridge 35, over the bag; and the combination of the cartridge 35, bag 42, and pair of side pads 39 and 40 is placed in the packaging carton 43, as shown in FIGS. 39 and 40.

The employment of the above described packaging carton in this embodiment structured so that an object (cartridge 35) to be packaged is to be inserted from one of the lengthwise ends of the packaging carton along with the combination of the above described packaging pouch, and packaging method, offers the following benefits:

(1) Instead of providing one of the lateral walls of a packaging carton, with an opening such as the opening 43 of a packaging carton in accordance with the prior art an opening 38*e* is located at one of the lengthwise end of a packaging carton, making the packaging carton stronger in overall strength.

Figure 31:
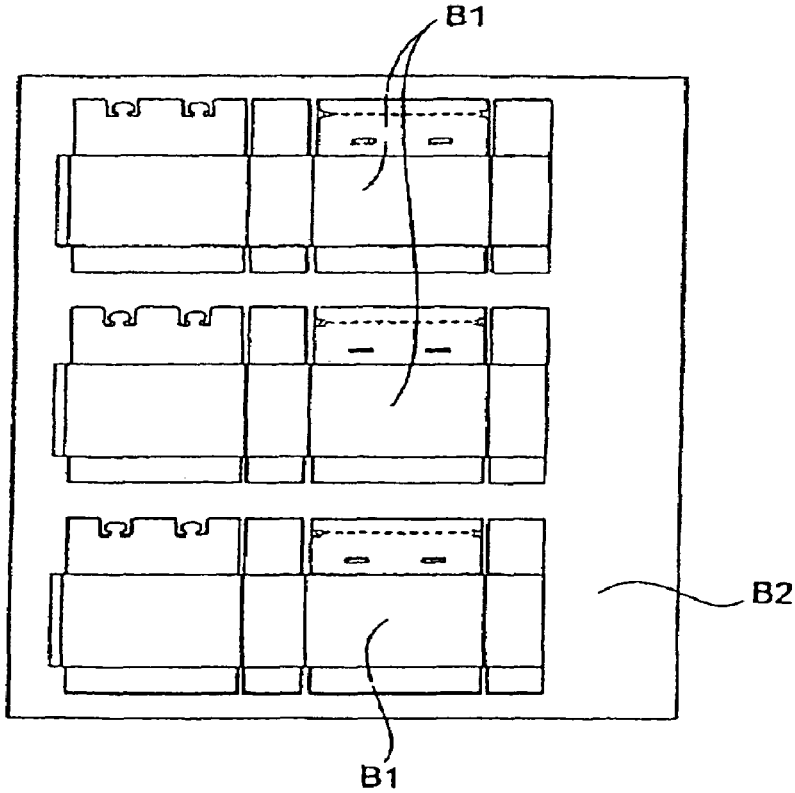
FIG.31 PRIOR ART
FIG. 31 is a development of a packaging carton in accordance with the prior art.
Figure 32:
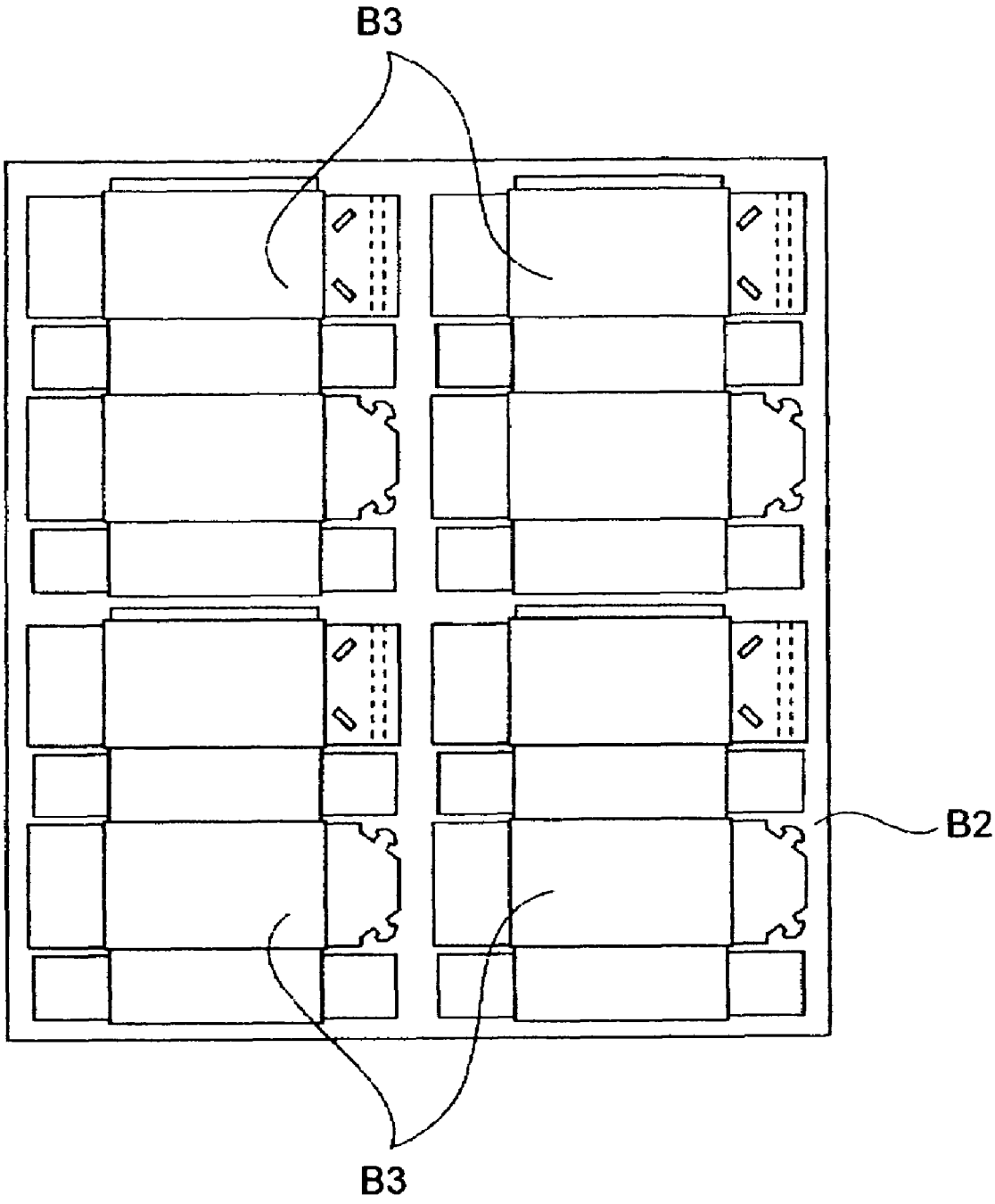
FIG. 32 is another development of the packaging carton in accordance with the present invention.

(2) The packaging carton in this embodiment is smaller, that is, the size of surface area, of material necessary to make it, than the packaging carton 43 in accordance with the prior art, as shown in FIGS. 25 and 27, for the following reason. That is, the tabs 38*a*-38*d* in this embodiment are smaller than the tabs 43*b*-43*d*. Therefore, the number of the full-sized development B1 of the packaging carton 43 in accordance with the prior art, which can be fitted on a single sheet B2 of cardboard, is only three, as shown in FIG. 31, whereas the number of the full-sized development B3 of the packaging carton 38 in this embodiment, which can be fitted on the single sheet B2 of cardboard is four, as shown in FIG. 32; in other words, only three packaging cartons 43 can be made from a single sheet B2 of cardboard, whereas four packaging cartons 38 can be made from a single sheet B2 of cardboard. Therefore, the employment of the structural design, in this embodiment, for a packaging carton, is effective to reduce packaging carton cost, and overall cartridge cost.

Figure 33:
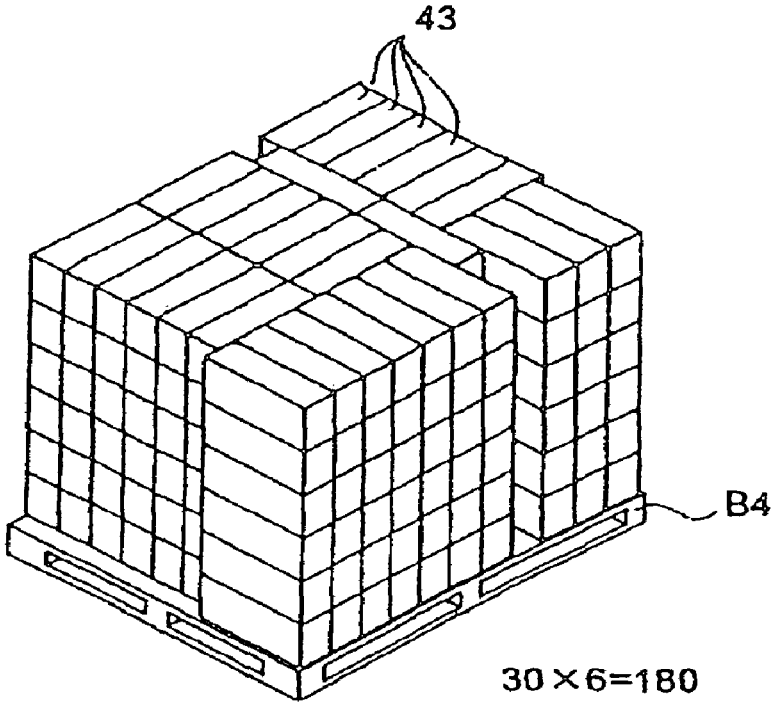
FIG.33 PRIOR ART
FIG. 33 is a perspective view of a transportation pallet, and 180 cartons, in accordance with the prior art, loaded on the pallet.

(3) The number of the cartons 43 in accordance with the prior art which can be mounted on a transportation pallet B4 is 180 (FIG. 33), whereas the number of the cartons 38 in this embodiment is 203 (FIG. 34), for the following two reasons. First, the carton 38 in this embodiment is smaller than the carton 43 in accordance with the prior art, and secondly, the carton 38 is greater in overall strength than the carton 43 in accordance wit the prior art, as described in Paragraph (1).

(4) The machine for making the packaging carton 38 can be made smaller than that for the packaging carton 43, because the packaging carton 38 can be finished from a smaller cut of material (cardboard), or the like.

(5) With the packaging carton 38, it is easier for a user to remove an object (cartridge 35) therefrom, because not only is the tearaway strip portion 38*f* of the packaging carton 38 smaller than the tearaway strip portion 43*f* of the packaging carton 43, but also, the packaging carton 38 does not require the aforementioned pair of side pads.

The wrapping method for wrapping an object with the above-described wrapping material can be summarized as follows.

The wrapping method for wrapping an object with the wrapping material S1 includes: a plurality of cushioning medium storage portions 3 for storing the cushiony medium; a plurality of the check valves 4 which allow the cushioning medium to pass through them into the cushioning medium storage portions 3, one for one, but prevent the cushioning medium from flowing backward from the cushioning medium storage portions 3 through them; a plurality of the guiding portions 5 for guiding the cushioning medium into the cushioning medium storage portions 3, one for one, through the check valves 4 from outside the wrapping material S1, in order to inflate the cushioning medium storage portions 3; the area 48 which is positioned upstream, in terms of the direction in which the cushioning medium is guided from the guiding portions 5 to the check valves 4, of the check valves 4, one for one, in order to prevent the portion of the cushioning medium having flowed backward from the cushioning medium storage portions 3 into the guiding portions 5 through the check valves 4, from leaking out of the wrapping material S1, and across which the wrapping material S1 is sealed after the cushioning medium storage portions 3 are filled with the cushioning medium, is characterized in that the wrapping material S1 is sealed across the area 48 after an object is placed in the pouch formed of the wrapping material S1, and then, the cushioning medium is injected into the cushioning medium storage portions 3 through the guiding portions 5.

The wrapping method for wrapping an object with the wrapping material S1 in accordance with the present invention is characterized in that each of the guiding portions 5 of the wrapping material 51 used by the wrapping method has the inlet 11, which is located at the outward end of the guiding portion 5, and through which the cushioning medium is injected into the cushioning medium storage portion 3 from outside the wrapping material S1, through the check valves 4, in the direction which is roughly the same as the direction in which the cushioning medium flows into the cushioning medium storage portion 3 through the check valve 4.

The wrapping method for wrapping an object with the wrapping material S1 in accordance with the present invention is characterized in that a plurality of cushioning medium storage portions 3 of the wrapping material S1 used by the wrapping method are positioned parallel to each other; the plurality of check valves 4 of the wrapping material S1 are provided one for each of the plurality of cushioning medium storage portions 3 and are independent of each other; a plurality of the guiding portions 5 of the wrapping material S1 are provided one for each of the plurality of cushioning medium storage portions 3; and the cushioning medium is injected into the cushioning medium storage portions 3 through the guiding portion 5 and check valves 4, one for one.

The wrapping method for wrapping an object with the wrapping material in accordance with the present invention is characterized in that each of the plurality of guiding portions 5 of the wrapping material S1 used by the wrapping method is provided with the inlet 11, which is positioned at the upstream end of the guiding portion 5, in terms of the cushioning medium injection direction, to inject the cushioning medium into the cushioning medium storage portion 3 from outside the wrapping material S1; the width WI of the inlet 11 is less than the width W2 of the joint between the guiding portion 5, and the check valve 4 located downstream of the guiding portion 5 in terms of the cushioning medium injection direction; and the plurality of inlets 11 are positioned side by side immediately next to each other.

Incidentally, the above-described wrapping method is a wrapping method suitable for manual operation.

The wrapping method for wrapping an object with the wrapping material S1 includes: a plurality of cushioning medium storage portions 3 for storing the cushioning medium; a plurality of the check valves 4 which allow the cushioning medium to pass through them into the cushioning medium storage portions 3, one for one, but prevent the cushioning medium from flowing backward from the cushioning medium storage portions 3 through them; a plurality of the guiding portions 5 for guiding the cushioning medium into the cushioning medium storage portions 3 through the check valves 4, one for one, from outside the wrapping material S1, in order to inflate the cushioning medium storage portions 3; the area 48 which is positioned upstream, in terms of the direction in which the cushioning medium is guided from the guiding portions 5 to the check valves 4, of the check valves 4, one for one, in order to prevent the portion of the cushioning medium having flowed backward from the cushioning medium storage portions 3 into the guiding portions 5 through the check valves 4, from leaking out of the wrapping material 81, and across which the wrapping material S1 is sealed after the cushioning medium storage portions 3 are filled with the cushioning medium, is characterized in that it comprises: the preparatory step of preparing the wrapping material S1; the positioning step of positioning an object in the pouch formed of the wrapping material S1; the injecting step of injecting the cushioning medium into the cushioning medium storage portions 3 through the guiding portions 5 after the positioning step; and the sealing step of sealing the pouch across the area 48.

The wrapping method for wrapping an object with the wrapping material S1 in accordance with the present invention is characterized in that in the preparatory step, the wrapping material S1 is prepared, the guiding portions 5 of which have the plurality of inlets 11, one for one, located at the upstream end, in terms of the injection direction, for injecting the cushioning medium from outside the wrapping material S1, and in the injection step, cushioning medium is injected through the inlets 11 in the direction roughly the same as the direction in which the cushioning medium passes through the check valves 4 toward the cushioning medium storage portions 3.

Further, the wrapping method for wrapping an object with the wrapping material in accordance with the present invention is characterized in that in the preparatory step, the wrapping material S1 is prepared, which has the plurality of the cushioning medium storage portions 3 positioned in parallel immediately next to each other, the plurality of check valves 4 provided one for each cushioning medium storage portion 3; and the plurality of guiding portions 5 provided one for each cushioning medium storage portion 3, and in the injection step, cushioning medium is injected into the cushioning medium storage portions 3 through the guiding portions 5 and check valves 4.

Further, the wrapping method for wrapping an object with the wrapping material 81 is characterized in that in the preparatory step, the wrapping material S1 is prepared, which has the plurality of guiding portions 5, each of which has the inlet 11 located at the upstream end, in terms of the cushioning medium injection direction, for injecting the cushioning medium from outside the wrapping material S1, the width WI of the inlet 11 being less than the width W2 of the joint between the guiding portion 5 and the check valve 4 on the downstream side of the guiding portion 5, in terms of the cushioning medium injection direction, and the plurality of inlets 11 being positioned immediately next to each other, and in the injection step, cushioning medium is injected through the plurality of inlets 11.

Incidentally, the above described wrapping method may be said to be suitable for a mechanical wrapping operation, for example, a wrapping operation using an automatic wrapping machine.

(Cushioning Medium Guiding Portion 5)

Figure 12:
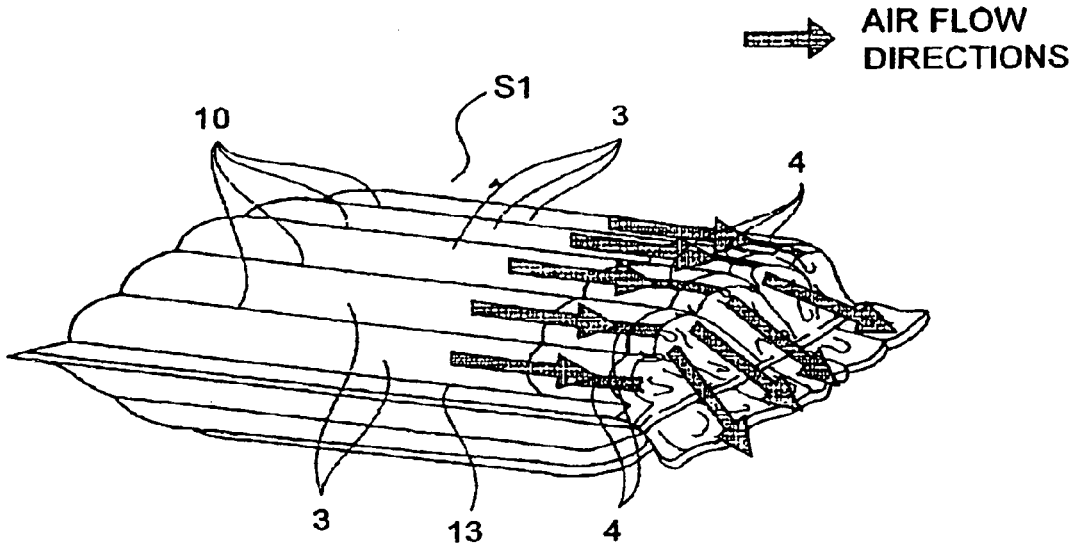
FIG. 12 PRIOR ART
FIG. 12 is a perspective view of a wrapping material in accordance with prior art, showing how air leaks from the cushioning medium storage portions.

As described above as the inflated wrapping material S1 is left unprotected in an environment which is high in temperature and humidity, and/or low in pressure, the cushioning medium storage portion 3 increases in internal pressure, causing thereby the cushioning medium (air) in the cushioning medium storage portion 3 to flow backward through the check valve 4. In this situation, the cushioning medium (air) in the cushioning medium storage portion 3 of the wrapping material in accordance with the prior art gradually leaks because the wrapping material in accordance with the prior art is not sealed across the guiding portion 5 as shown in FIG. 12.

Therefore, there is a concern that an object wrapped with the wrapping material in accordance with the prior art cannot be totally protected from shocks.

Figure 11:
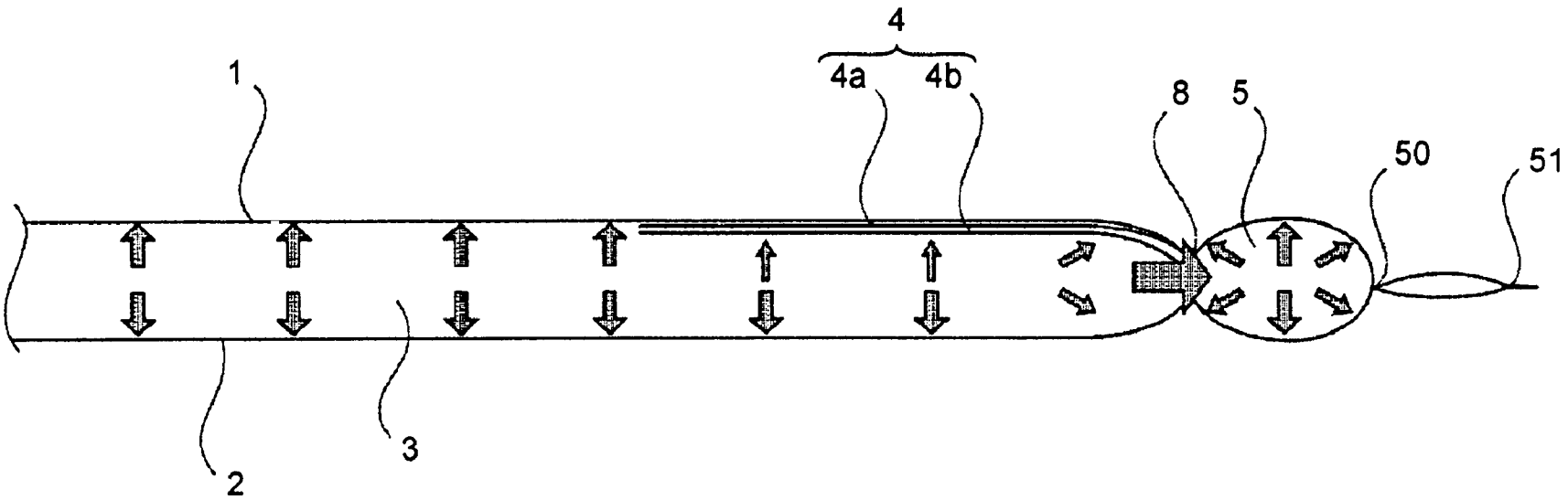
FIG. 11 is a sectional view of one of the cushioning medium storage portions of the wrapping material, showing the state of storage portion, in which the internal pressure of the storage portion is high.
Figure 13:
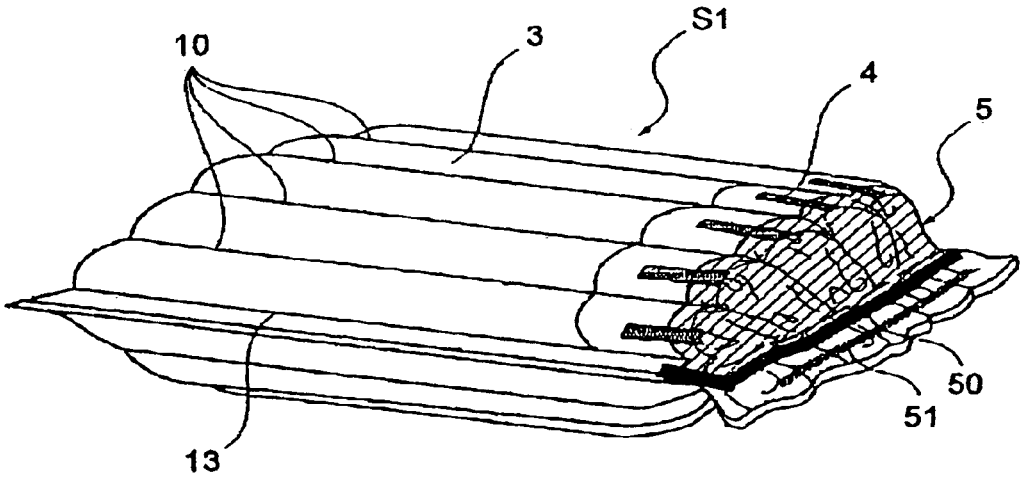
FIG. 13 is a perspective view of the wrapping material in accordance with the present invention.

Thus, in this embodiment, the guiding portion is utilized as a buffer portion in which the air having flowed backward through the check valve 4 due to the increase in the internal pressure of the cushioning medium storage portion 3 is retained, as shown in FIGS. 10, 11, and 13. In other words, the air having flowed backward from the cushioning medium storage portion 3 into the guiding portion 5 through the check valve 4 can be prevented, by sealing the wrapping material S1 across the guiding portion 5 along the lines 50 and 51, from leaking out of the wrapping material S1 through the guiding portion 5. With the wrapping material S1 sealed across the guiding portion 5, even if the cushioning medium (air) flows backward through the check valve 4 due to the changes in the environment in which an object wrapped with the wrapping material S1 is stored, or due to the like cause, the cushioning medium does not leak out of the wrapping material S1. More specifically, when the inflated wrapping material in accordance with the prior art, that is, the wrapping material which did not have the buffer zone, was left unprotected in a severe test environment (400 in temperature and 95% in humidity), the internal pressure of this wrapping material S1, which was initially 50 Kpa, dropped to 0 Kpa in 24 hours. In comparison, when the inflated wrapping material S1 in this embodiment was left unprotected in the same severe test environment (40° in temperature and 95% in humidity), the internal pressure of this wrapping material S1, which also was 50 Kpa initially, was roughly 20 Kpa even after 60 days. Incidentally, at this rate of pressure loss, it will take 4.58 years for the internal pressure of 50 Kpa of the inflated wrapping material S1 in this embodiment to drop to 10 Kpa, if the inflated wrapping material S1 in this embodiment is left unprotected in the normal environment (230 in temperature and 60% in humidity). In other words, wrapping an object with the wrapping material S1 in this embodiment assures that the object remains protected from shocks.

Figure 14:
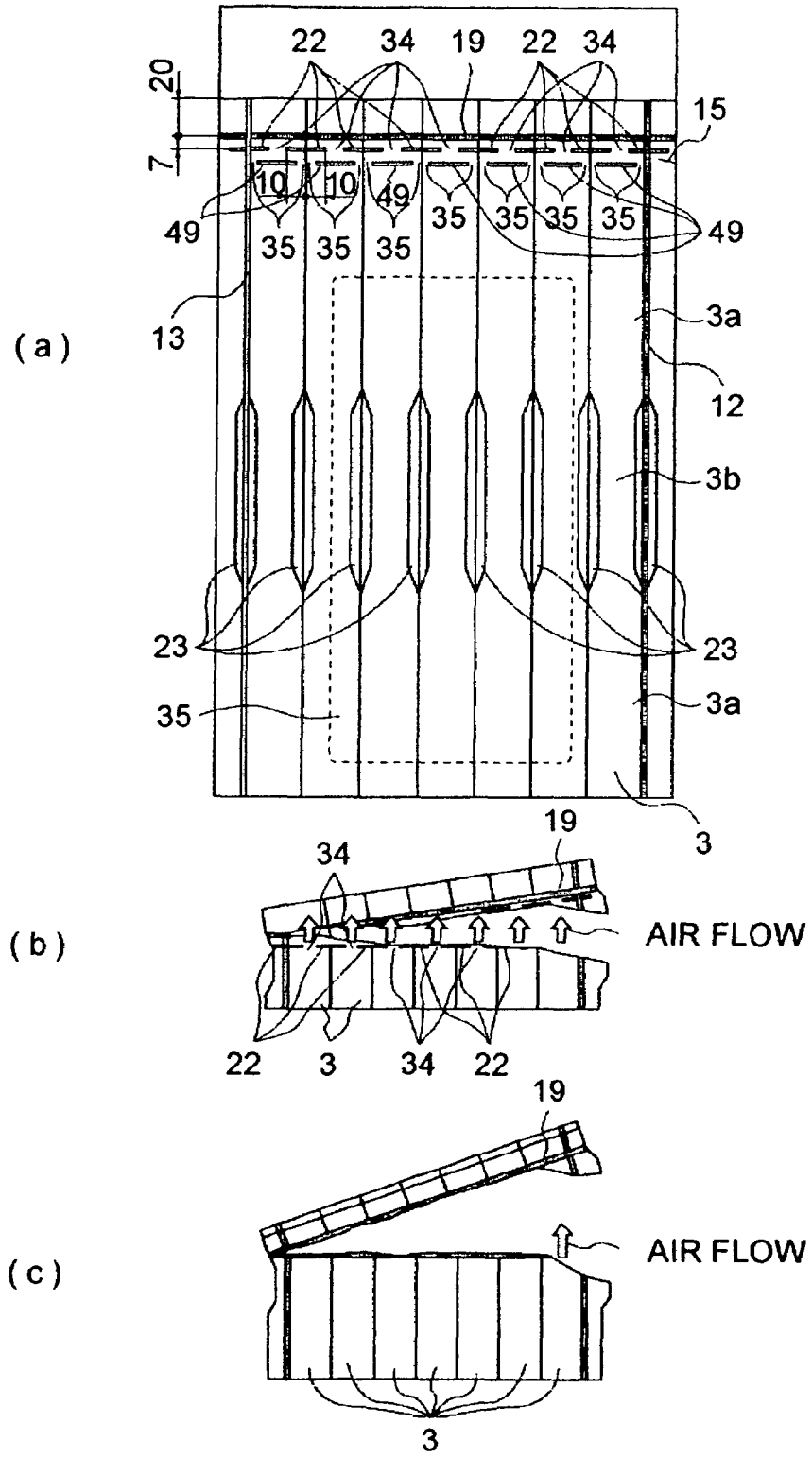
FIG. 14(*a*) is a plan view (reverse side) thereof.
Figure 15:
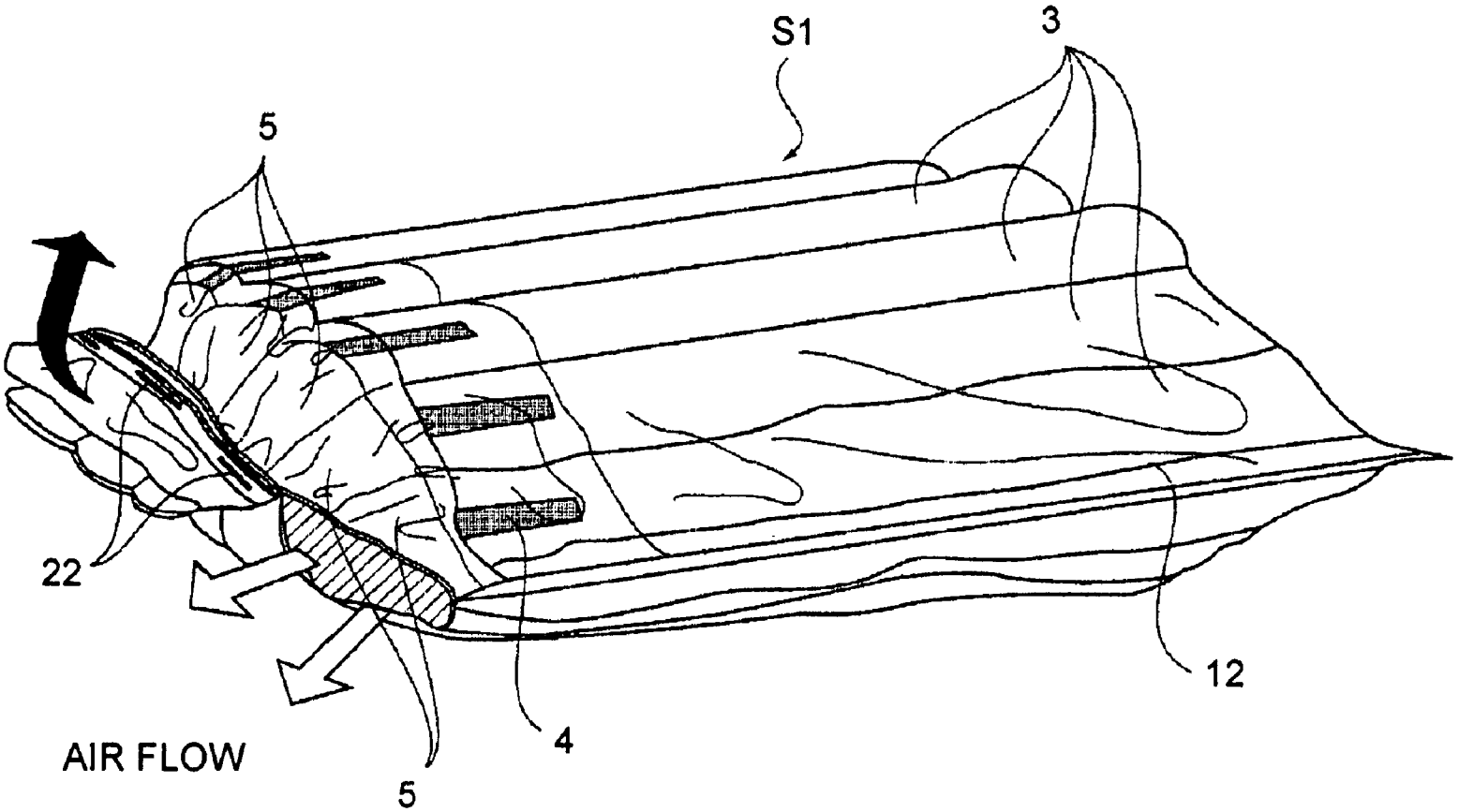
FIG. 15 is a perspective view of the wrapping material in accordance with the present invention, showing how the wrapping material is torn from the notch to unseal the wrapping material.
Figure 16:
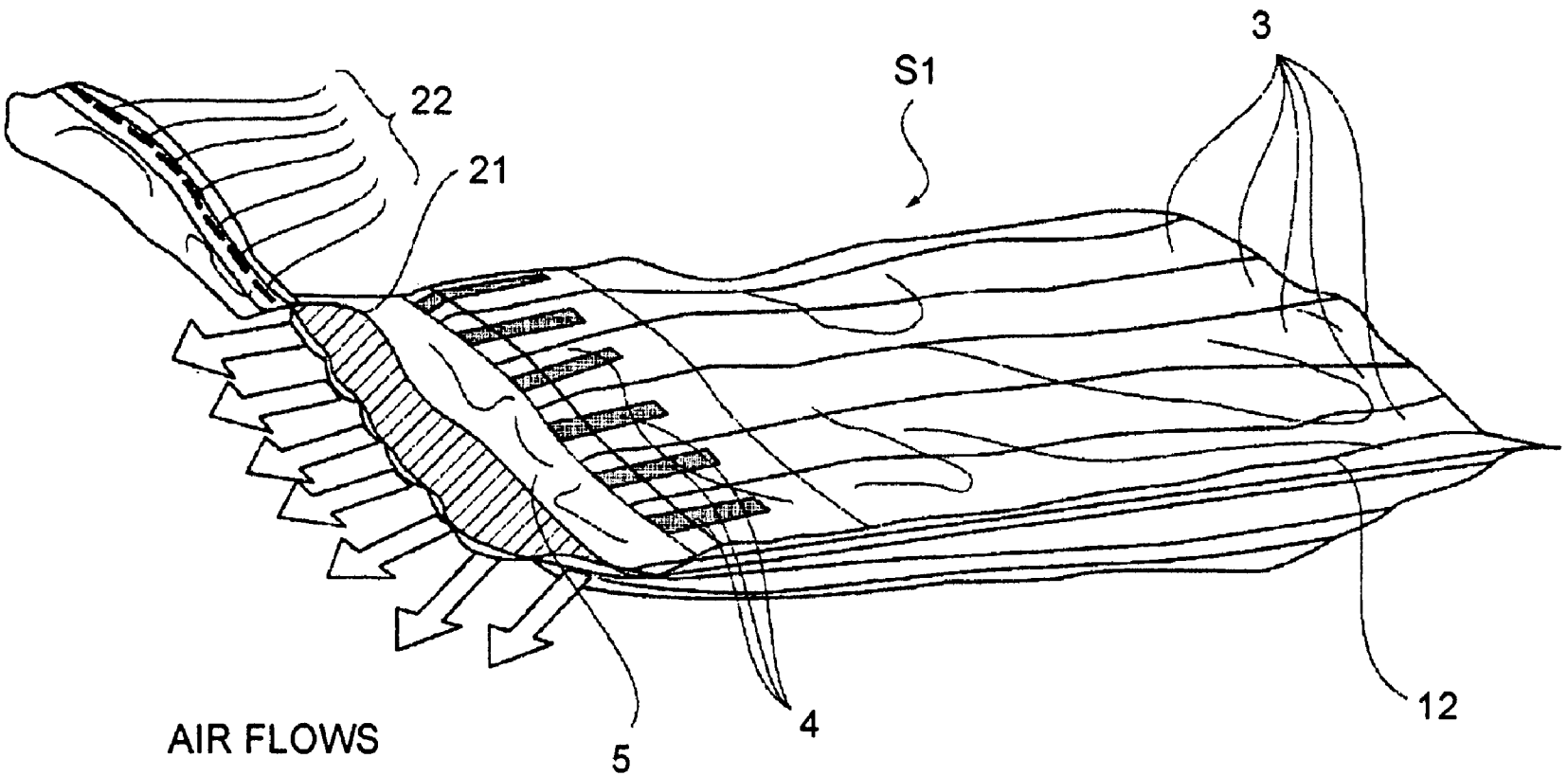
FIG. 16 is a perspective view of the wrapping material in accordance with the present invention, showing how the wrapping material was torn from the notch to unseal the wrapping material.

One of the long edges of the wrapping material S1 in this embodiment is provided with the notch 15, which corresponds in position to a point between the lines 8 and 50 (FIG. 6). The surface of the wrapping material S1 is made coarse, across the adjacencies of the notch 15, providing an anti-slip area, in order to make it easier for a user to tear the wrapping material S1 starting from the notch 15. The anti-slip area is on the upstream side, in terms of the cushioning medium injection direction, from the line 8 (welding seam) along which the wrapping material S1 is thermally sealed between the upstream end of the cushioning medium storage portion 3 and guiding portion 5. The notch 15 is located outward of the line 12, in terms of the direction perpendicular to the lengthwise direction of the cushioning medium storage portion 3. Thus, as the wrapping material S1 is torn starting from the notch 15, the cushioning medium storage portions 3 are torn as shown in FIGS. 15 and 16, not only is an opening 21 through which the cartridge 35 can be taken out, but also, the air remaining in the cushioning medium storage portions 3 is released, reducing thereby the used wrapping material S1 in volume, and therefore, making it easier to remove the cartridge 35 from the pouch formed of the wrapping material S1. Further, the wrapping material S1 is welded along the lines 22 and 49, as shown in FIG. 14(*a*), in order to assure that the cushioning medium storage portions 3 (wrapping material S1) are torn in the direction intersectional to the lengthwise direction of the cushioning medium storage portion 3. FIG. 14(*a*) is a plan view of the reverse side of the pouch, which is formed of the wrapping material S1 and contains the cartridge 35. The line 22 along which the wrapping material S1 is welded is located 7 mm inward of the welding line 19 (check valve 4). These welding seams have a length of 20 mm and are positioned with predetermined intervals. The line 49 along which the wrapping material S1 is welded is on the inward side of the line 22. These welding seams also have a length of 20 mm and are positioned with predetermined intervals. The welding lines along the lines 19 and 49 are formed by thermal welding. Without the presence of the tear guiding welding seams 19 and 49, the wrapping material S1 (cushioning medium storage portions 3) are difficult to tear in the direction perpendicular to the lengthwise direction of the cushioning medium storage portion 3, making it difficult to remove the object (cartridge 35) from the pouch formed of the wrapping material S1; it is more likely for the wrapping material S1 to be torn along the line 19 (welding seam), as shown in FIG. 14(*c*), making it difficult to release the air in the cushioning medium storage portions 3. Referring to FIG. 14(*a*), the tear guiding welding seams 22 are extended astride the welding seams 10 between the adjacent two cushioning medium storage portions 3, one for one, because, if the tear guiding welding seams 22 do not straddle the welding seams 10 one for one, the welding seams 10 resist the tearing action, making it virtually impossible to tear the wrapping material S1 in the direction perpendicular to the guiding portion 5, starting from the notch 15. As will be evident from the above description, there are provided an interval 34 (portion which has not been welded) between the adjacent two welding seams 22, and an interval 35 (portion which has not been welded) between the adjacent two welding seams 49, so that even if the wrapping material S1 were to become torn between the tear guiding welding seam 19 and tear guiding welding seam 22, the cushioning medium (air) in the cushioning medium storage portions 3 can be released. These tear guiding welding seams 22 and 49 are created when the wrapping material S1 is in the form shown in FIG. 3.

Figure 23:
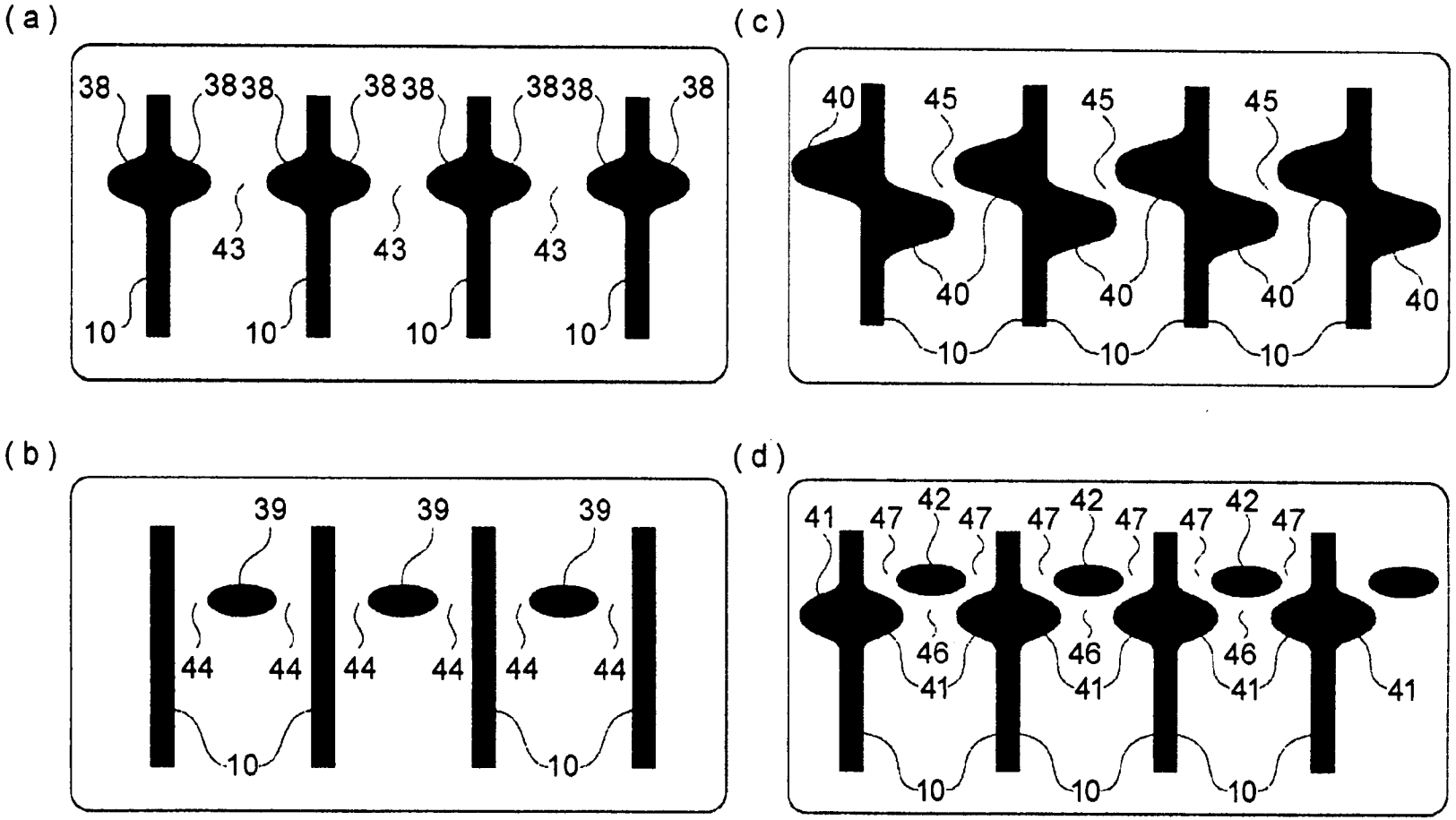
FIGS. 23(*a*), 23(*b*), 23(*c*) and 23(*d*) are plan views of the tear guiding portions of the wrapping material in accordance with the present invention.

The tear guiding welding seams 22 and 49 may be shaped like the tear guiding welding areas 38 shown in FIG. 23(*a*), tear guiding areas 39 in FIG. 23(*b*), tear guiding areas 40 in FIG. 23(*c*), or combinations of the tear guiding areas 41 and 48 in FIG. 23(*d*). Also in these cases, there are provided the areas 43, 44,46, and 47, respectively, across which the front and reverse sides of the wrapping material S1 have not been welded to allow the air in the cushioning medium storage portions 3 to escape.

(Cushioning Medium Storage Portion)

Figure 17:
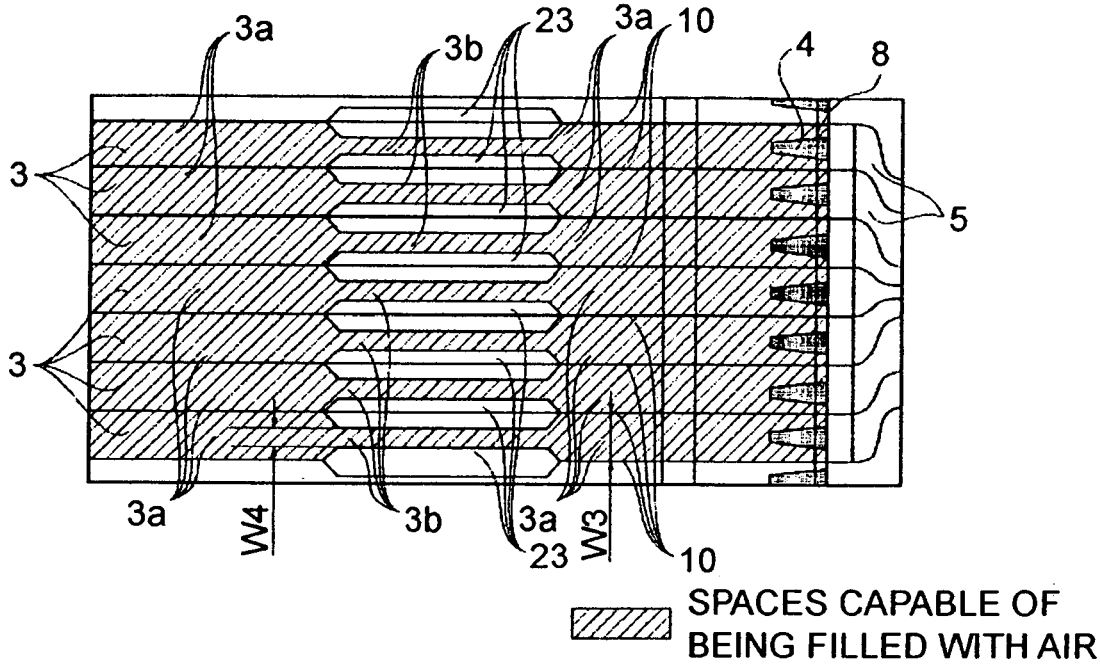
FIG. 17 is a plan view of another wrapping material in accordance with the present invention.
Figure 18:
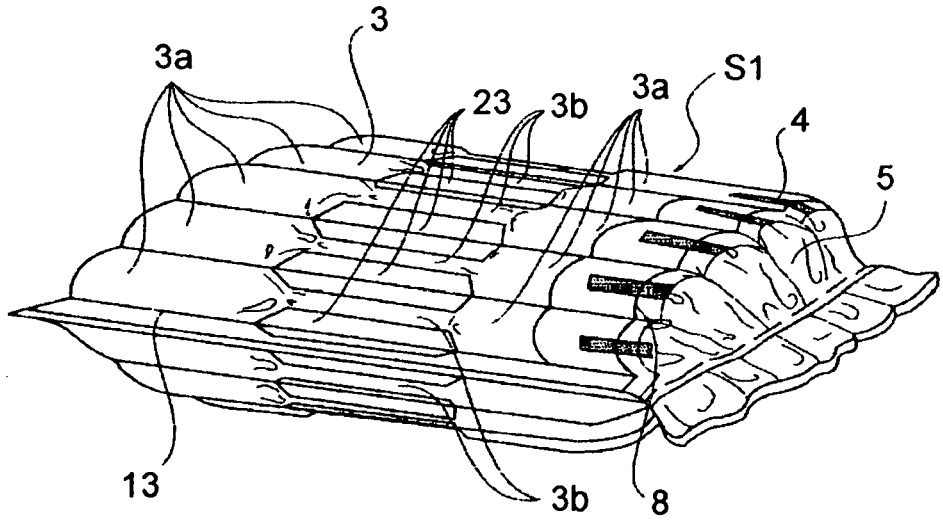
FIG. 18 is a perspective view of the wrapping material in accordance with the present invention.

The cushioning medium storage portion 3 in this embodiment is characterized in that it is provided with an area which is narrower, in terms of the direction perpendicular to the lengthwise direction of the cushioning medium storage portion 3, than the rest of the cushioning medium storage portion 3, and which is located at a predetermined location in terms of the lengthwise direction of the cushioning medium storage portion 3. With the provision of this narrow area 3*b*, the pressure which will apply to the cartridge 35 after the injection of the cushioning medium into the cushioning medium storage portions 3 can be reduced. Referring to FIG. 17, the width W4 of the narrow area 3*b* is less than the width W3 of the upstream and downstream areas 3*a* of the cushioning medium storage portion 3, with respect to the narrow area 3*b*, in terms of the air injection direction. In other words, the cross section of the narrow portion 3*b* of the cushioning medium storage portion 3 is less than that of the other areas 3*a* of the cushioning medium storage portion 3. Also referring to FIG. 17, the narrow portion 3*b* can be formed by widening, in the direction perpendicular to the lengthwise direction of the cushioning medium storage portion 3, the portion 23 of the welding seam 10, across which the films 1 and 2 are welded to each other, within the range which corresponds in position to the narrow area 3*b*. The wider welding seam 23 is also thermally formed by an dedicated welding apparatus (unshown). In this embodiment, the width W3 is in the range of 35-35 mm, and the width W4 of the narrow area 3*b* is in the range of 15-20 mm.

Figure 7:
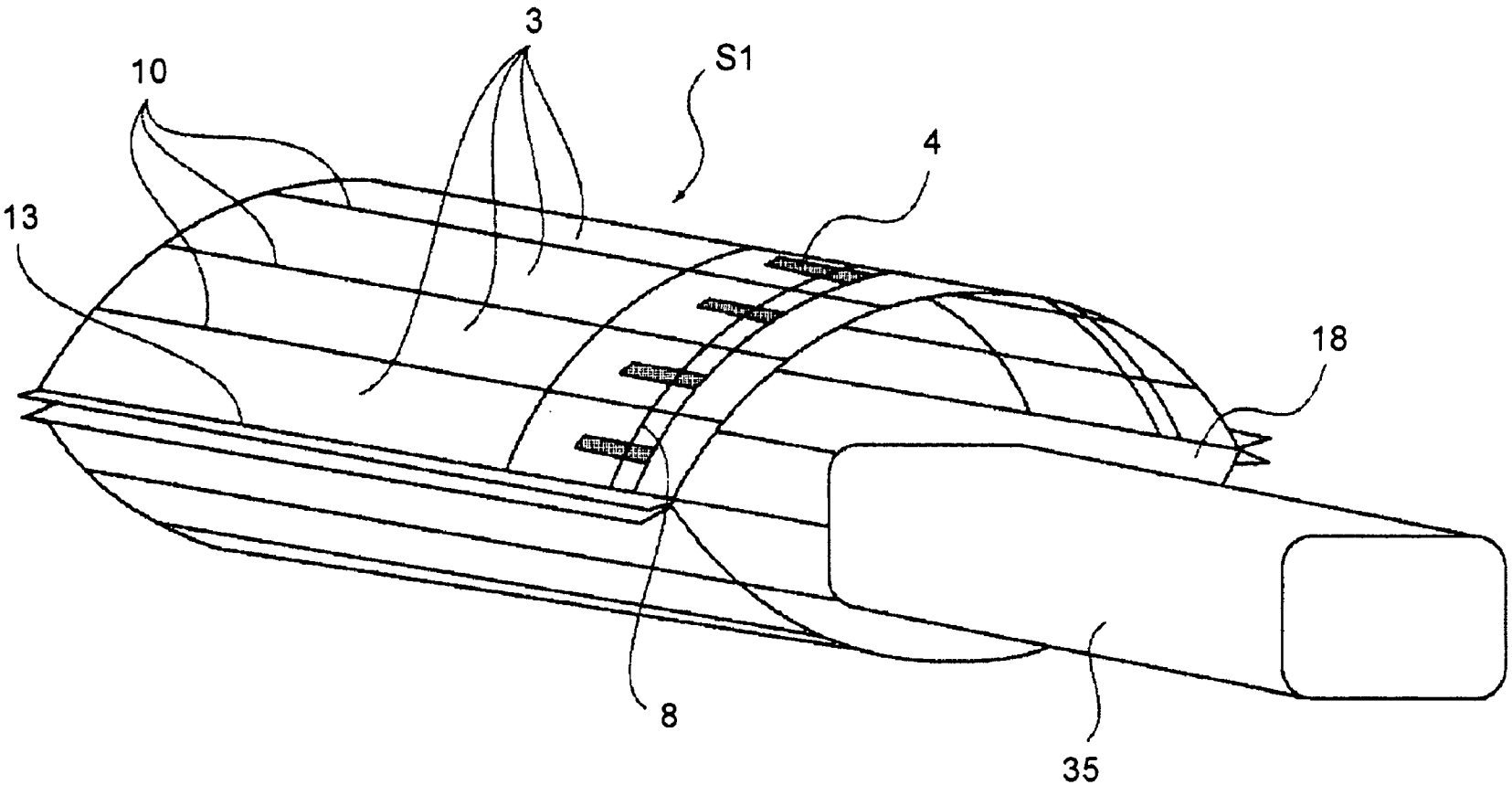
FIG. 7 is a perspective view of the wrapping material in accordance with the present invention, showing another step for wrapping a cartridge with the wrapping material in accordance with the present invention (cartridge insertion step).
Figure 19:
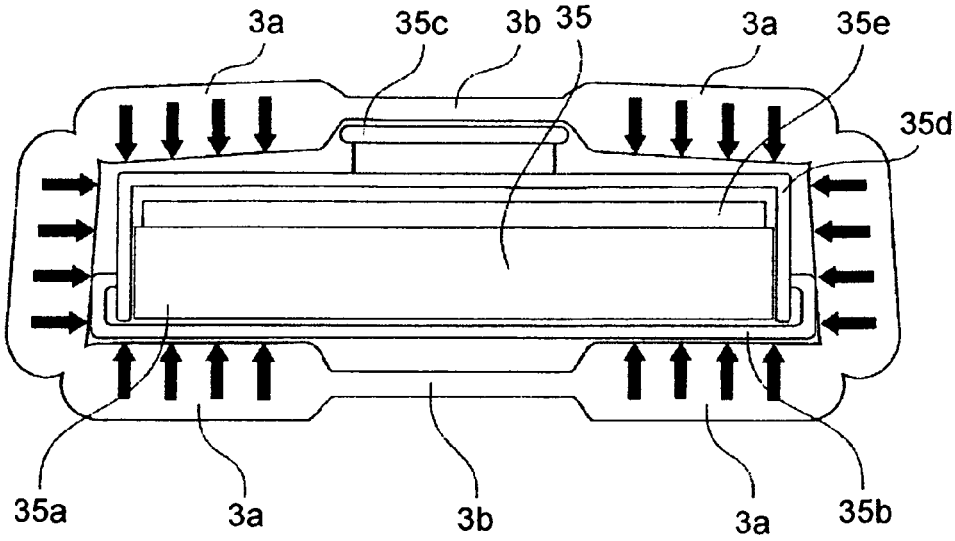
FIG. 19 is a sectional view of the wrapping material in accordance with the present invention.
Figure 19:
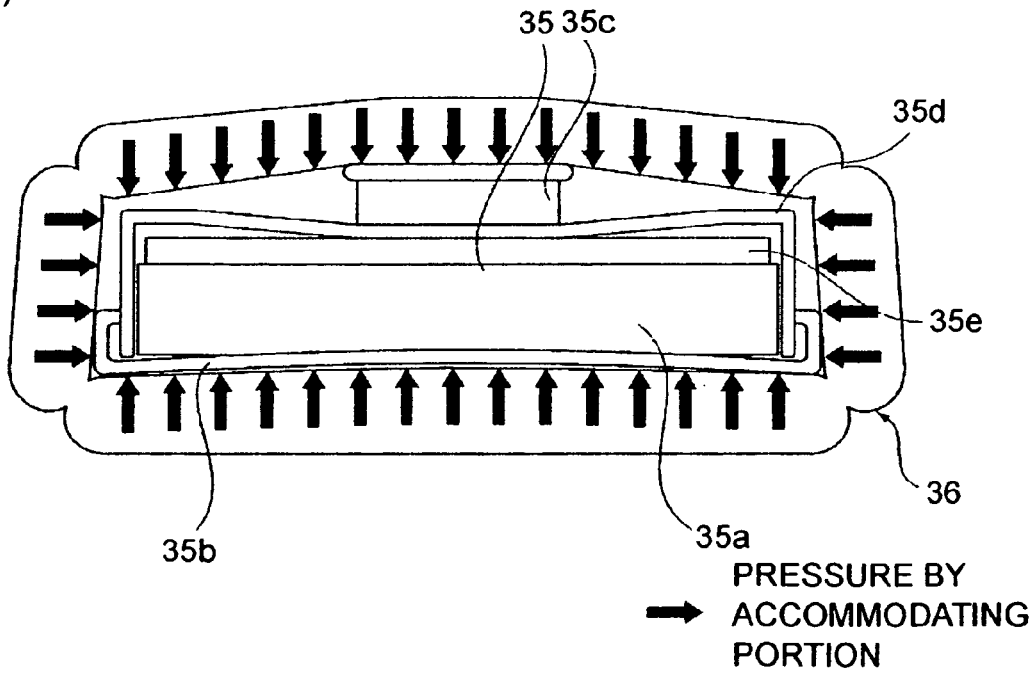

This embodiment is characterized in that the wrapping material 51 is structured so that the amount by which air can be injected into the center portion of each of the cushioning medium storage portions of the wrapping material 51, which corresponds in position to the approximate center portion of an object (cartridge 35) to be wrapped, is smaller than the amount by which air can be injected into the upstream and downstream portions, in terms of the air injection direction, of each of the cushioning medium storage portions of the wrapping material 51, with respect to the center portion. Referring to FIGS. 7 and 8, in this embodiment, the amount of the air which can be injected into the center portion 3*b* of the cushioning medium storage portion 3 is reduced by reducing the center portion 3*b* in the width, in terms of the direction perpendicular to the lengthwise direction of the cushioning medium storage portion 3, compared to the rest 3*a* of the cushioning medium storage portion 3. The width of the center portion 3*b* of the cushioning medium storage portion 3 can be reduced by widening the welding seam 23, across the range corresponding to the center portion 3*b*. With the center portion 3*b* of the cushioning medium storage portion 3 reduced in the amount of air injectable into it, the amount of the air pressure which applies to the approximate center portion of the object (cartridge 35) is smaller (FIG. 19(*a*)). When the object to be wrapped with the wrapping material 51 happens to be the cartridge 35, the center portion of the cartridge 35, where the housing 35*d*, cover 35*b*, handle 35*c*, etc., of the cartridge 35 are located, is more likely to be deformed by the pressure from the air in the cushioning medium storage portion 3 than the end portions of the cartridge 35. Further, the photosensitive drum 35*a* and transfer roller 35*e* of the cartridge 35 are likely to be deformed by the deformations of the housing 35*d*, cover 35*b*, etc., of the cartridge 35, as shown in FIG. 19(*b*). Thus, the portion 3*b* of the cushioning medium storage portion 3, which is narrower in terms of the direction, perpendicular to the lengthwise direction of the cushioning medium storage portion 3 than the rest 3*a* of the cushioning medium storage portion 3 is centrally positioned in terms of the lengthwise direction of the cushioning medium storage portion 3, in order to prevent the pressure from the cushioning medium storage portion 3 from being applied to the center portion of the cartridge 35. Thus, the wrapping material S1 must be structured so that before the wrapping material S1 is formed into a pouch, the narrow center portion 3*b* of the cushioning medium storage portion 3 will align with the center portion of the object (cartridge 35) to be wrapped with the wrapping material S1.

Figure 20:
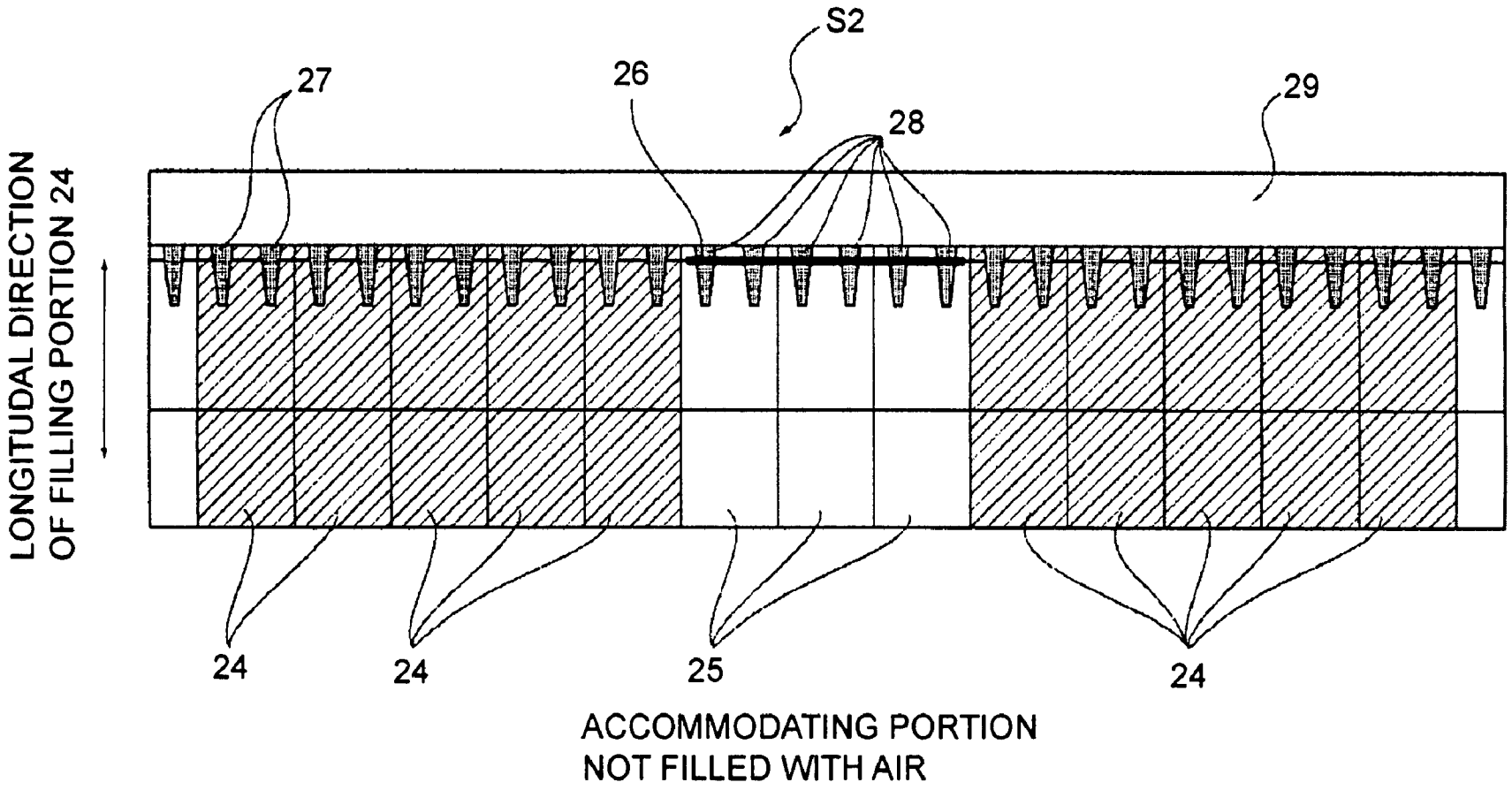
FIG. 20 is a plan view of another wrapping material in accordance with the present invention.
Figure 21:
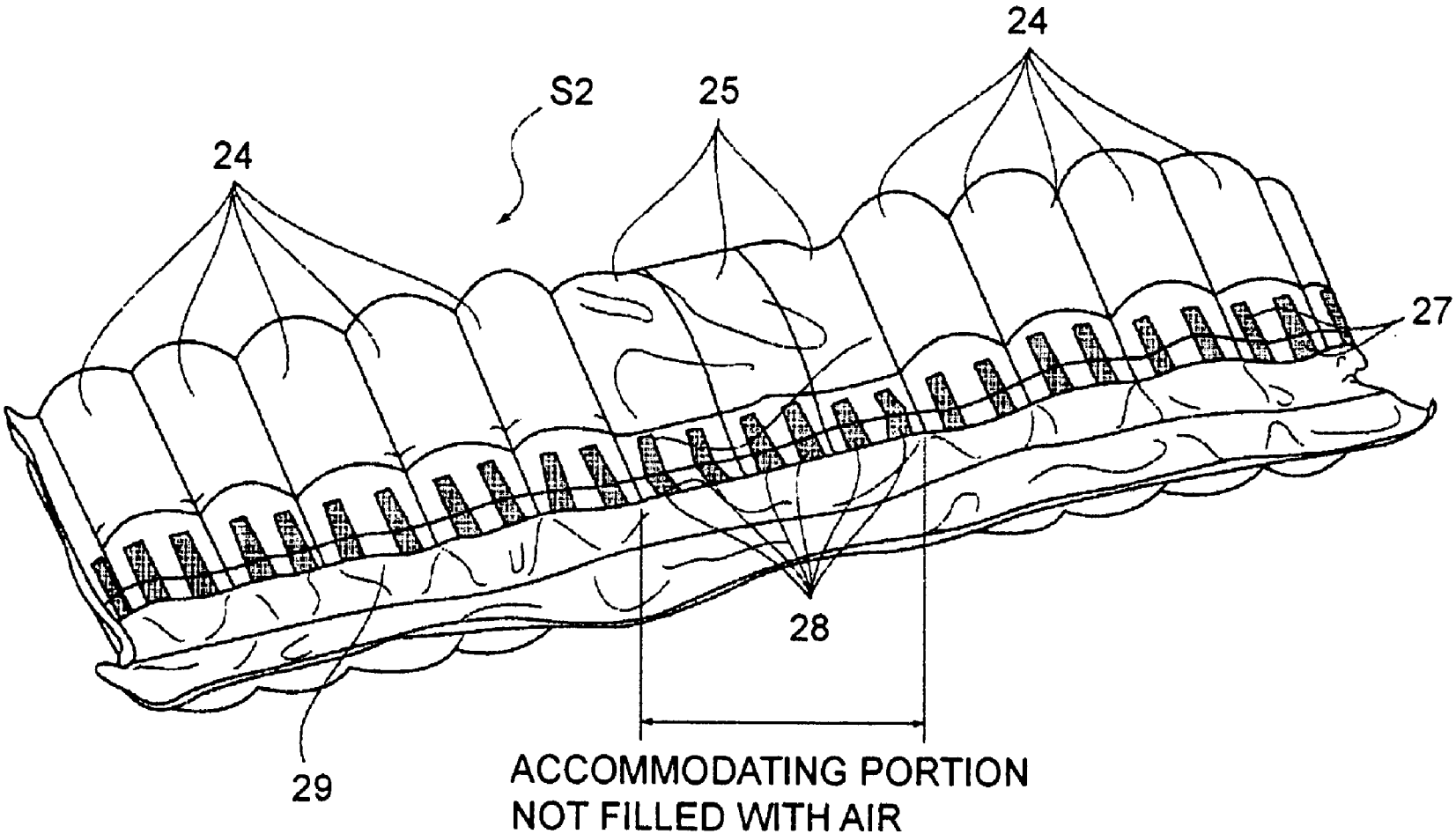
FIG. 21 is a perspective view of the wrapping material in accordance with the present invention.
Figure 22:
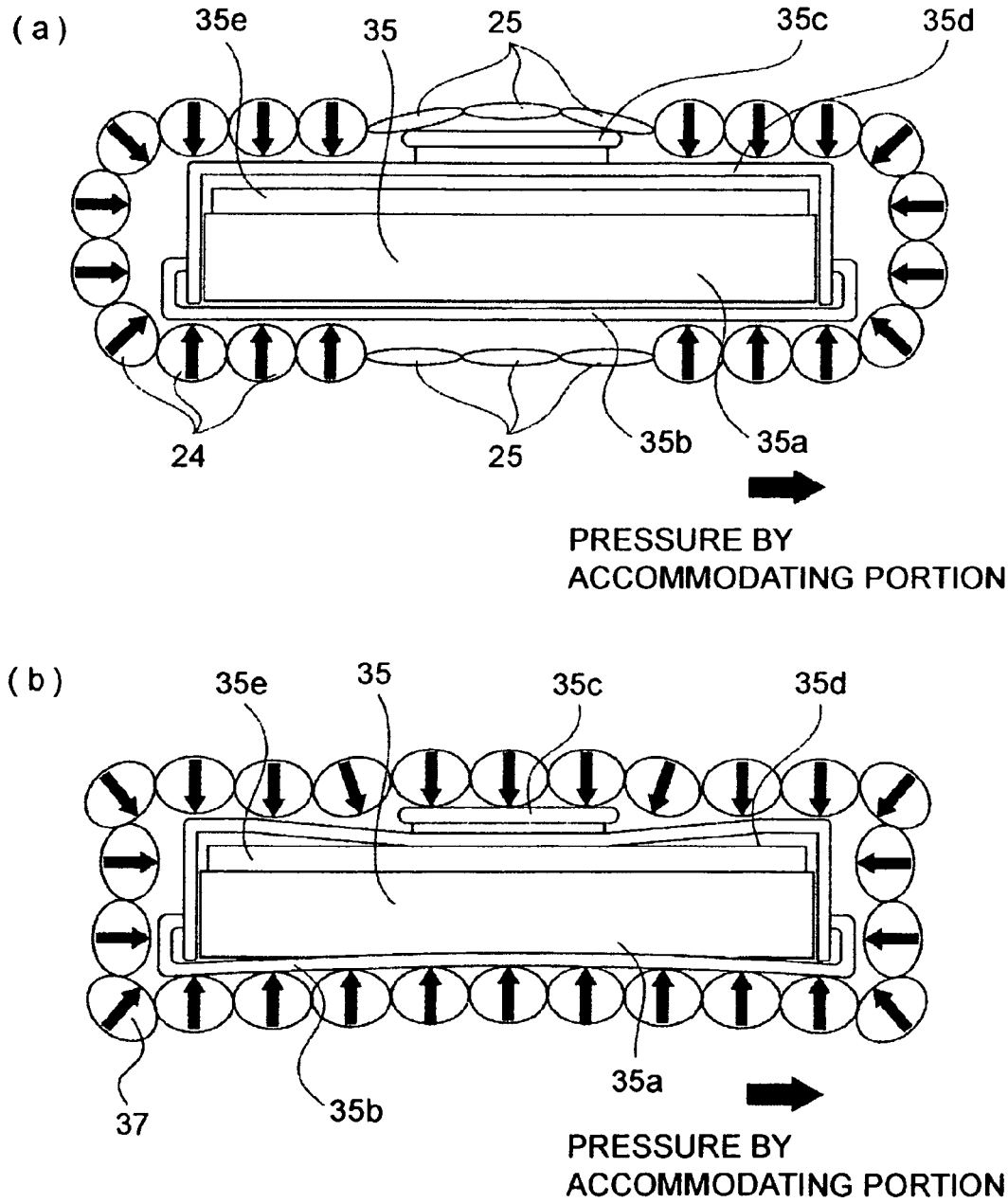
FIGS. 22(*a*) and 22(*b*) are sectional views of the wrapping material in accordance of the present invention.

Referring to FIGS. 20 and 21, in the case of a wrapping material S2, the lengthwise direction of the cushioning medium storage portions 3 of which is perpendicular to the axial direction of the photosensitive drum 35*a* of the cartridge 35, it is possible to shut the check valves 28 by welding the front and reverse sides of the wrapping material S2 to each other along a line 26 (welding seam), in order to prevent air from being injected into the area of the wrapping material S2, which corresponds in position to the center portion of the process cartridge 35 in terms of the axial direction of the photosensitive drum 35*a*. With the provision of this structural arrangement, it is possible for the wrapping material S2 to be inflated so that the center portion of the cartridge 35 is not pressured by the portion 25 of the wrapping material S2, as shown in FIG. 22(*a*) (FIG. 22(*b*) shows the cartridge 35, the cartridge housing 35*d* and cover 35*b* of which have been deformed, as in FIG. 19(*b*)). FIG. 22(*a*) shows that, as the cartridge 35 is wrapped with the wrapping material S2, the cushioning medium storage portions 25 of the wrapping material S2, into which air cannot be injected, is positioned against the handle 35*c* of the cartridge 35.

Figure 35:
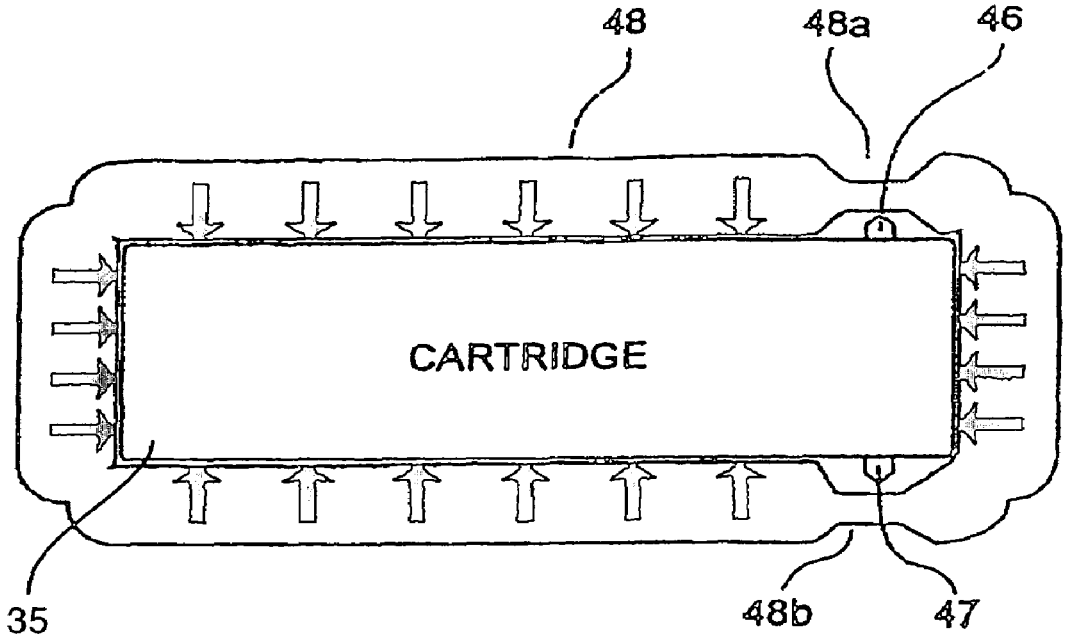
FIG. 35 is a sectional view of a combination of the wrapping material in accordance with the present invention, and the cartridge wrapped therewith.

As described above, in this embodiment, the width of each of the cushioning medium storage portions 3 of the wrapping material S1, in terms of the direction perpendicular to the lengthwise direction of the cushioning medium storage portion 3, is reduced across its center portion, in terms of the lengthwise direction of the cushioning medium storage portion 3, which corresponds in position to the center portion of the object (cartridge 35), in terms of the lengthwise direction of the cartridge 35, or the cushioning medium storage portions 3 of the wrapping material S2, which correspond in position to the center portion of the cartridge 35, are shut in order to prevent air from being injected into them. However, the structural arrangement in this embodiment may be modified as shown in FIG. 35, which shows the case in which an object (cartridge 35) having projections 46 and 47, which are not centrally located, is wrapped with the wrapping material S. In this case, the cushioning medium storage portions 3 of the wrapping material S may be reduced in width, across the portions corresponding to the projections 46 and 47 of the object (cartridge 35), or the cushioning medium storage portions 3 of the wrapping material S may be shut across the portions corresponding to the projections 46 and 47 of the object (cartridge 35), in order to prevent the problem that the cushioning medium storage portions 3 are damaged by the projections 46 and 47, and the air therein escapes from the cushioning medium storage portions 3.

Incidentally, the wrapping materials S (S1 and S2) in this embodiment were described with reference to the cartridge 35 as the object to be wrapped with the wrapping materials S (S1 or S2). However, the wrapping materials S may be used for wrapping the object other than the cartridge 35; for example, an ink cartridge for an ink jet printer, a camera, the main assembly of a printer, a video camera, a fixation unit removably mountable in an electrophotographic image forming apparatus, etc. Further, the flexible material for the wrapping materials S may be paper film, metal film, etc., instead of plastic film.

(Manufacturing Method for Wrapping Material)

The manufacturing method for the inflatable wrapping material for wrapping an object can be summarized as follows.

The manufacturing method, in accordance with the present invention, of inflatable wrapping material comprises;

the sheet laying step of placing two pieces of flexible sheet, that is, the plastic films 1 and 2, in layers;

the cushioning medium storage portion forming step of welding the layered first and second films to each other, along multiple parallel lines (welding seams 9 and 10) in order to form the cushioning medium storage portions 3 for holding the cushioning medium;

the cushioning medium storage portion sealing step of welding the plastic films 1 and 2, having been layered in the sheet laying step, to each other along the line 6 (welding seam) in the adjacencies of one of the lengthwise ends of the wrapping material S formed in the cushioning medium storage portion forming step;

the check valve attaching step of attaching the check valve which allows the cushioning medium to pass through it toward the cushioning medium storage portion while preventing the cushioning medium in the cushioning medium storage portion from flowing backward through it, to the lengthwise end of each of the cushioning medium storage portion, opposite to the thermally sealed end; and the guiding portion forming step of welding the plastic films 1 and 2 having been layered in the sheet layer step, the lines extending from the lines 9 and 10 (welding seams) to the lengthwise end of the wrapping material S, opposite to the sealed lengthwise end, in order to form the guiding portions 5 for guiding the cushioning medium into the cushioning medium storage portions, one for one, and also, in order to form, on the upstream of the check valve 4 in terms of the direction in which the cushioning medium is guided toward the check valve 4 through the guiding portion, the area 48 across which the wrapping material S will be sealed, after the injection of the cushioning medium into the cushioning medium storage portions, to seal the wrapping material S to prevent the portion of the cushioning medium having flowed backward from the cushioning medium storage portion 3 into the guiding portion 5 through the check valve 4, from leaking out of the wrapping material 5 through the guiding portion 5.

The wrapping material S is shaped to be long and narrow, and comes in the form of a roll having a large number of wrapping materials S connected by their lengthwise edges so that the lengthwise edges of the wrapping materials S become perpendicular to the lengthwise edges of the roll, and the widthwise edges of the wrapping materials S become parallel to the lengthwise edges of the roll.

The aforementioned manufacturing method for the wrapping material S1 comprises the cutting step of obtaining a wrapping unit containing a desired number of wrapping materials S1 by cutting the roll of wrapping materials S1 in the direction perpendicular to the edges of the roll, that is, the direction parallel to the widthwise direction of the wrapping material S1.

The manufacturing method also comprises: the folding step of folding the wrapping unit in the direction perpendicular to the widthwise direction of the wrapping material S1 after the cutting step; and the pouch forming step of welding the two halves of the wrapping unit to each other along the long or short edges (welding seams 12 and 13), forming the wrapping unit into a pouch which is open across one of the edges.

Further, the manufacturing method comprises: the object placement step of placing an object in the pouch formed in the pouch forming step; the cushioning medium injection step of injecting the cushioning medium into the cushioning medium storage portions through the guiding portions after the object placement step; and the sealing step of sealing the wrapping unit across the sealing area 48 after the cushioning medium injection step.

Although, in the case of the wrapping material manufacturing method in this embodiment, the plastic films 1 and 2 placed in layers were attached to each other by welding, along the predetermined lines (welding seams). However, choice of the method for bonding the plastic film 1 and 2 does not need to be limited to welding; any means may be employed as long as the two films 1 and 2 can be sealed along the predetermined lines.

According to this embodiment it is assured that an object can be wrapped with the wrapping material S so that the cushioning medium in the wrapping material S will not leak out of the wrapping material S due to the changes in ambience, or the like. Further, it is possible to manufacture a wrapping material capable of protecting the wrapped object from shocks. Further, the wrapping material S can be injected with the cushioning medium after the shipment of the wrapping material S to its final destination, being therefore superior in transportation efficiency. Further, the wrapping material S can be modified in accordance with the properties of the object to be wrapped.

As described above, according to the present invention, even if the cushioning medium in a wrapping material flows backward through the check valve due to the changes in ambience, or the like, it does not leak out of the wrapping material, assuring that an object will remain safely wrapped, that is, remains protected from external shocks. Also according to the present invention, the lengthwise direction of the wrapping material, and the direction in which the cushioning medium is injected through the inlet, are made roughly the same as the direction in which cushioning medium passes through the check valve. Therefore, the wrapping material in accordance with the present invention is superior in the efficiency with which the cushioning medium can be injected into the cushioning medium storage portions of the wrapping material. Further, according to the present invention, a wrapping material may be injected with cushioning medium after the shipment of the wrapping material to its final destination, being therefore superior in transportation efficiency.

While the invention has been described with reference to the structures disclosed herein, it is not confined to the details set forth, and this application is intended to cover such modifications or changes as may come within the purposes of the improvements or the scope of the following claims.

What is claimed is:

1. A manufacturing method for a packing member for packing an article, comprising:

an overlapping step of overlapping flexible sheets;

a medium accommodating portion forming step of sealing the sheets at a plurality of positions while they are overlapped to provide a plurality of medium accommodating portions arranged in the form of an array;

a medium accommodating portion sealing step of sealing the sheets sealed by said medium accommodating portion forming step, at one longitudinal end of the packing member;

a non-return valve mounting step of mounting a non-return valve to another longitudinal end of the packing member sealed by said medium accommodating portion forming step, wherein the non-return valve is effective to permit flow of the medium to each of the medium accommodating portions and to limit flow of the medium in an opposite direction, wherein the non-return valve is provided for each of the medium accommodating portions, wherein said non-return valve mounting step comprises the steps of:

mounting a sealing portion of the non-return valve between the flexible sheets having a melting temperature above the melting temperature of the flexible sheets;

sealing the flexible sheets in a direction crossing the longitudinal direction of the medium accommodating portions without sealing the portion of the flexible sheets located across the non-return valve sealing portion; and an introducing portion forming step of sealing the flexible sheets overlapped by said overlapping step at the one longitudinal end to form a plurality of introducing portions for permitting introduction of the medium into each of the medium accommodating portions, wherein each of the introducing portions is independently provided for each of the medium accommodating portions, wherein each of said introducing portions has an injection port configured and positioned to permit the introduction of the medium from outside of said packing member at an upstream end with respect to the direction of the introduction of the medium, wherein each of said injection ports has a width that is narrower than a connection portion between an associated non-return valve and its associated introducing portion provided downstream of its associated introducing portion with respect to the direction of the introduction of the medium, and wherein each of said injection ports is adjacent to another injection port.

2. A method according to claim 1, further comprising the step of preparing a plurality of the packing members in the form of a roll elongated in a direction perpendicular to the longitudinal direction.

3. A method according to claim 2, further comprising a cutting step of cutting the roll in a widthwise direction of said roll to prepare at least one of the packing members.

4. A method according to claim 3, further comprising:

a fold-back step of folding back at least one packing member cut from the roll by said cutting step in a direction perpendicular to a widthwise direction of said at least one packing member; and a bag forming step of forming the thus folded-back at least one packing member into a bag form by sealing edges thereof except for one edge.

5. A method according to claim 4, further comprising:

an article accommodating step of accommodating an article in the bag formed by said bag forming step; and a medium introduction step of introducing the medium into each of the medium accommodating portions with the introducing portions after said article accommodating step, wherein the packing member includes a sealing region, disposed upstream of the non-return valve with respect to a direction of the introduction of the medium from the introducing portion toward the non-return valve, for sealing each of the introducing portions to prevent the medium from leaking to an outside of the packing member, the sealing region being sealed to keep the medium in each of the introducing portions, wherein the sealing region is sealed after said article accommodating step and said medium introducing step.

* * * * *